US010981224B2

(12) United States Patent
Kaneda et al.

(10) Patent No.: US 10,981,224 B2
(45) Date of Patent: Apr. 20, 2021

(54) CASTING DEVICE AND EMERGENCY STOP METHOD

(71) Applicant: SINTOKOGIO, LTD., Nagoya (JP)

(72) Inventors: Keishiro Kaneda, Toyokawa (JP); Yukiyoshi Funakoshi, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 16/647,495

(22) PCT Filed: Sep. 25, 2018

(86) PCT No.: PCT/JP2018/035340
§ 371 (c)(1),
(2) Date: Mar. 14, 2020

(87) PCT Pub. No.: WO2019/065588
PCT Pub. Date: Apr. 4, 2019

(65) Prior Publication Data

US 2020/0269313 A1 Aug. 27, 2020

(30) Foreign Application Priority Data

Sep. 26, 2017 (JP) ..... JP2017-184810

(51) Int. Cl.
*B22D 46/00* (2006.01)
*B22D 33/04* (2006.01)
*B22D 23/00* (2006.01)

(52) U.S. Cl.
CPC ..... *B22D 46/00* (2013.01); *B22D 23/006* (2013.01); *B22D 33/04* (2013.01)

(58) Field of Classification Search
CPC ..... B22D 33/04; B22D 46/00; B22D 23/006
See application file for complete search history.

(56) References Cited

U.S. PATENT DOCUMENTS

| | | | | |
|---|---|---|---|---|
| 9,950,364 | B2 * | 4/2018 | Suzuki | B22D 41/06 |
| 10,201,851 | B2 * | 2/2019 | Funakoshi | B22D 23/006 |
| 2015/0132180 | A1 | 5/2015 | Tilak et al. | |

FOREIGN PATENT DOCUMENTS

| | | | |
|---|---|---|---|
| CN | 102858480 | A | 1/2013 |
| CN | 104550782 | A | 4/2015 |
| CN | 105479700 | A | 4/2016 |
| CN | 105517732 | A | 4/2016 |
| CN | 106604793 | A | 4/2017 |

(Continued)

OTHER PUBLICATIONS

International Preliminary Report on Patentability dated Apr. 9, 2020 for PCT/JP2018/035340.

*Primary Examiner* — Kevin E Yoon
(74) *Attorney, Agent, or Firm* — Faegre Drinker Biddle & Reath LLP

(57) ABSTRACT

A casting apparatus includes a first drive unit closing or opening an upper mold and a lower mold, a second drive unit tilting the closed upper mold and lower mold, an optical sensor and a control unit. When the optical sensor detects an object during a casting period after molten metal is supplied to the upper mold and the lower mold tilted by the second drive unit until the molten metal is cooled, the control unit does not shut off power supplies to the first drive unit and the second drive unit, causes the first drive unit to continue mold closing and causes the second drive unit to hold the tilting position.

18 Claims, 17 Drawing Sheets

(56) References Cited

FOREIGN PATENT DOCUMENTS

| | | | |
|---|---|---|---|
| CN | 106660114 | A | 5/2017 |
| CN | 107107183 | A | 8/2017 |
| JP | 2003-25059 | A | 1/2003 |
| JP | 2013-188760 | A | 9/2013 |
| JP | 2013-252658 | A | 12/2013 |
| JP | 5880792 | B1 | 3/2016 |
| JP | 2016-529111 | A | 9/2016 |
| WO | WO-2015/033311 | A1 | 3/2015 |
| WO | WO-2016/166906 | A1 | 10/2016 |

* cited by examiner

CASTING DEVICE AND EMERGENCY STOP METHOD

TECHNICAL FIELD

The present disclosure relates to a casting apparatus and an emergency stop method.

BACKGROUND ART

Patent Document 1 discloses a gravity type tilting die casting apparatus. This apparatus is provided with an upper frame, a lower frame, an opening/closing mechanism, a first main link member, a first sub-link member and a drive unit. An upper mold is attached to the upper frame. A lower mold is attached to the lower frame. The opening/closing mechanism opens or closes the upper mold and the lower mold by moving either the upper mold or the lower mold up and down. A top end part of the first main link member is rotatably connected to the upper frame, a bottom end part of the first main link member is rotatably connected to the lower frame, and the first main link member is provided with a rotating shaft at a central part thereof. The first sub-link member is disposed parallel to the first main link member, a top end part of the first sub-link member is rotatably connected to the upper frame, and a bottom end part of the first sub-link member is rotatably connected to the lower frame and is provided with a rotating shaft at a central part thereof. The drive unit is connected to the rotating shaft of the first main link member and rotates the first main link member around the rotating shaft. The upper frame, the lower frame, the first main link member and the first sub-link member constitute a first parallel link mechanism.

CITATION LIST

Patent Document

Patent Document 1: Japanese Patent Publication No. 5880792

SUMMARY OF INVENTION

Technical Problem

With regard to securing safety of workers, there is a conceivable measure in which a presence detector such as a light curtain is provided, and when the detector detects entry of a worker, the casting apparatus in operation may be stopped in emergency. Generally, emergency stop is realized by immediately shutting off power (power supply) to an actuator. However, when the power (power supply) to the actuator is shut off, restoration may take time depending on a casting step. In the present technical field, even in the case of emergency stop, the casting apparatus is expected to achieve immediate restoration.

Solution to Problem

An aspect of the present disclosure is a casting apparatus that forms a casting by using an upper mold and a lower mold, which can be opened, closed, and tilted, into which molten metal is poured by using gravity. The casting apparatus includes a first drive unit, a second drive unit, an optical sensor and a control unit. The first drive unit moves either the upper mold or the lower mold up and down to open or close the upper mold and the lower mold. The second drive unit tilts the upper mold and the lower mold which are closed by the first drive unit. The optical sensor is disposed in the periphery of the casting apparatus and detects an object. When an object is detected by the optical sensor, the control unit shuts off the power supply to the first drive unit and the second drive unit. When the optical sensor detects an object for a casting period after molten metal is supplied into the upper mold and the lower mold tilted by the second drive unit until the molten metal is cooled, the control unit does not shut off the power supply to the first drive unit and the second drive unit, causes the first drive unit to continue mold closing and causes the second drive unit to keep tilting position.

When the optical sensor detects an object, this casting apparatus shuts off power supply to the first drive unit and the second drive unit. Operations of the first drive unit and the second drive unit are thereby completely stopped. On the other hand, when the operations of the first drive unit and the second drive unit are completely stopped during the casting period after the molten metal is supplied into the upper mold and the lower mold tilted by the second drive unit until the molten metal is cooled, it is no longer possible to keep the tilting position, the molten metal is not fully supplied into the molds, but coagulates in such a condition, making it hard to remove the molten metal from the mold, increasing the possibility that the molds will be opened without the molten metal coagulating sufficiently. When the apparatus falls into such a situation, it takes time to recover. For this reason, when the optical sensor detects an object during the above casting period, the casting apparatus does not shut off power supply to the first drive unit and the second drive unit, the first drive unit continues mold closing and the second drive unit keeps the tilting position. This makes it possible to prevent an insufficient amount of the molten metal from coagulating or the molds from opening, and the operation can therefore be restored speedily even when the apparatus stops in emergency.

In an embodiment, the first drive unit may include a hydraulic cylinder, a first hydraulic pump supplying hydraulic oil to the hydraulic cylinder, a first pump electric motor driving the first hydraulic pump and a first drive control unit controlling the first pump electric motor. When the optical sensor detects an object during the above casting period, the power supply to the first drive control unit is not shut off, but the first hydraulic pump continues driving, torque by the hydraulic cylinder is kept, thus making it possible to continue mold closing.

In an embodiment, the first drive unit may include an electric cylinder and a first electric control unit driving the electric cylinder. When the optical sensor detects an object during the above casting period, the power supply to the first electric control unit is not shut off, and torque by the electric cylinder is kept, and so mold closing can be continued. Furthermore, since the power supply to the first electric control unit is not shut off, no origin returning processing for the electric cylinder is necessary, which eliminates the necessity for time for returning.

In an embodiment, the second drive unit may include a hydraulic motor, a second hydraulic pump supplying hydraulic oil to the hydraulic motor, a second pump electric motor driving the second hydraulic pump and a second drive control unit controlling the second pump electric motor. When the optical sensor detects an object during the above casting period, the power supply to the second drive control unit is not shut off, the second hydraulic pump continues driving, torque by the hydraulic motor is kept, and so it is possible to keep the tilting position.

In an embodiment, the second drive unit may include an electric motor and a second electric control unit driving the electric motor. When the optical sensor detects an object during the above casting period, the power supply to the second drive unit is not shut off, and torque by the electric motor is kept, and so the tilting position can be kept. Since the power supply to the second drive unit is not shut off, no origin returning processing for the electric cylinder is necessary, which eliminates the necessity for time for returning.

In an embodiment, the casting apparatus may also include an upper frame to which an upper mold is attached, a lower frame to which a lower mold is attached, a first main link member, a top end part of which is rotatably connected to the upper frame, a bottom end part of which is rotatably connected to the lower frame and a central part of which is provided with a rotating shaft, and a first sub-link member disposed parallel to the first main link member, a top end part of which is rotatably connected to the upper frame, a bottom end part of which is rotatably connected to the lower frame and a central part of which is provided with a rotating shaft. The upper frame, the lower frame, the first main link member and the first sub-link member may constitute a first parallel link mechanism. The casting apparatus operating through such a link mechanism can eliminate the necessity for time for returning.

Another aspect of the present disclosure is an emergency stop method for a casting apparatus that forms a casting by using an upper mold and a lower mold, which can be opened, closed, and tilted, into which molten metal is poured by using gravity. The casting apparatus includes a first drive unit moving either the upper mold or the lower mold up and down to open or close the upper mold and the lower mold and a second drive unit tilting the upper mold and the lower mold closed by the first drive unit. The emergency stop method includes steps of, deter mining, when an object is detected by the optical sensor disposed in the periphery of the casting apparatus, whether or not detection timing is included in a casting period after the molten metal is supplied into the tilted upper mold and lower mold until the molten metal is cooled, and performing first stop processing, when it is determined that the detection timing is not included in the casting period, in which power supplies to the first drive unit and the second drive unit are shut off or performing second stop processing, when it is determined that the detection timing is included in the casting period, in which the power supplies to the first drive unit and the second drive unit are not shut off, the first drive unit is caused to continue mold closing and the second drive unit is caused to keep tilting position.

According to this emergency stop method, it is possible to exert the same effects as those of the aforementioned casting apparatus.

Advantageous Effects of Invention

According to the present disclosure, even when the casting apparatus is stopped in emergency, normal operation can be restored speedily.

DESCRIPTION OF EMBODIMENTS

Figure 1:
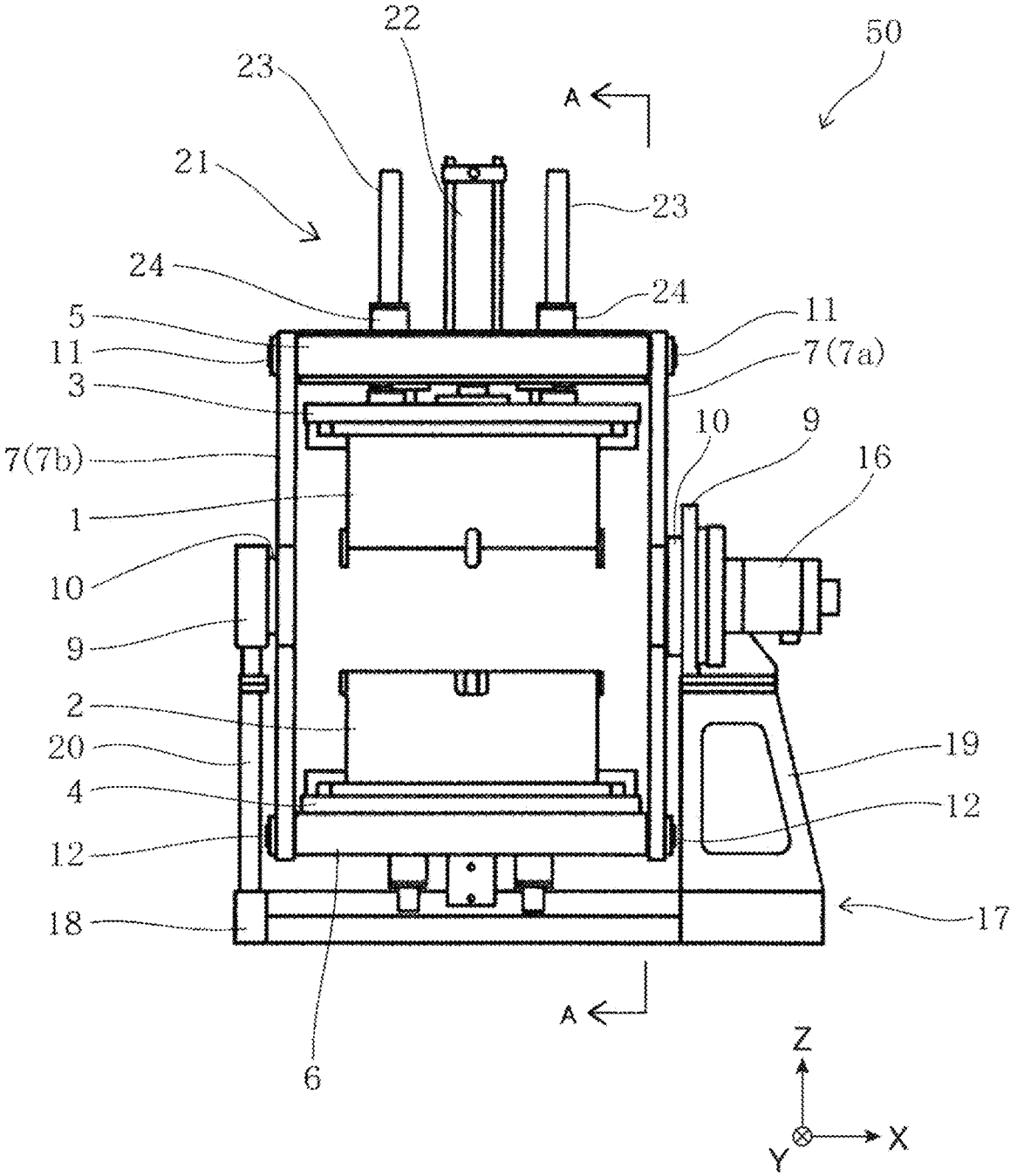
FIG. 1 is a front view of a casting apparatus according to a first embodiment.

Hereinafter, embodiments of the present invention will be described with reference to the accompanying drawings. Note that the same elements in description of the drawings are assigned the same reference numerals and duplicate description thereof will be omitted. Moreover, dimensional ratios among the drawings do not always correspond to those in the description. Terms like "up," "down," "left" and "right" are based on the illustrated states and used for convenience' sake.

First Embodiment

Figure 2:
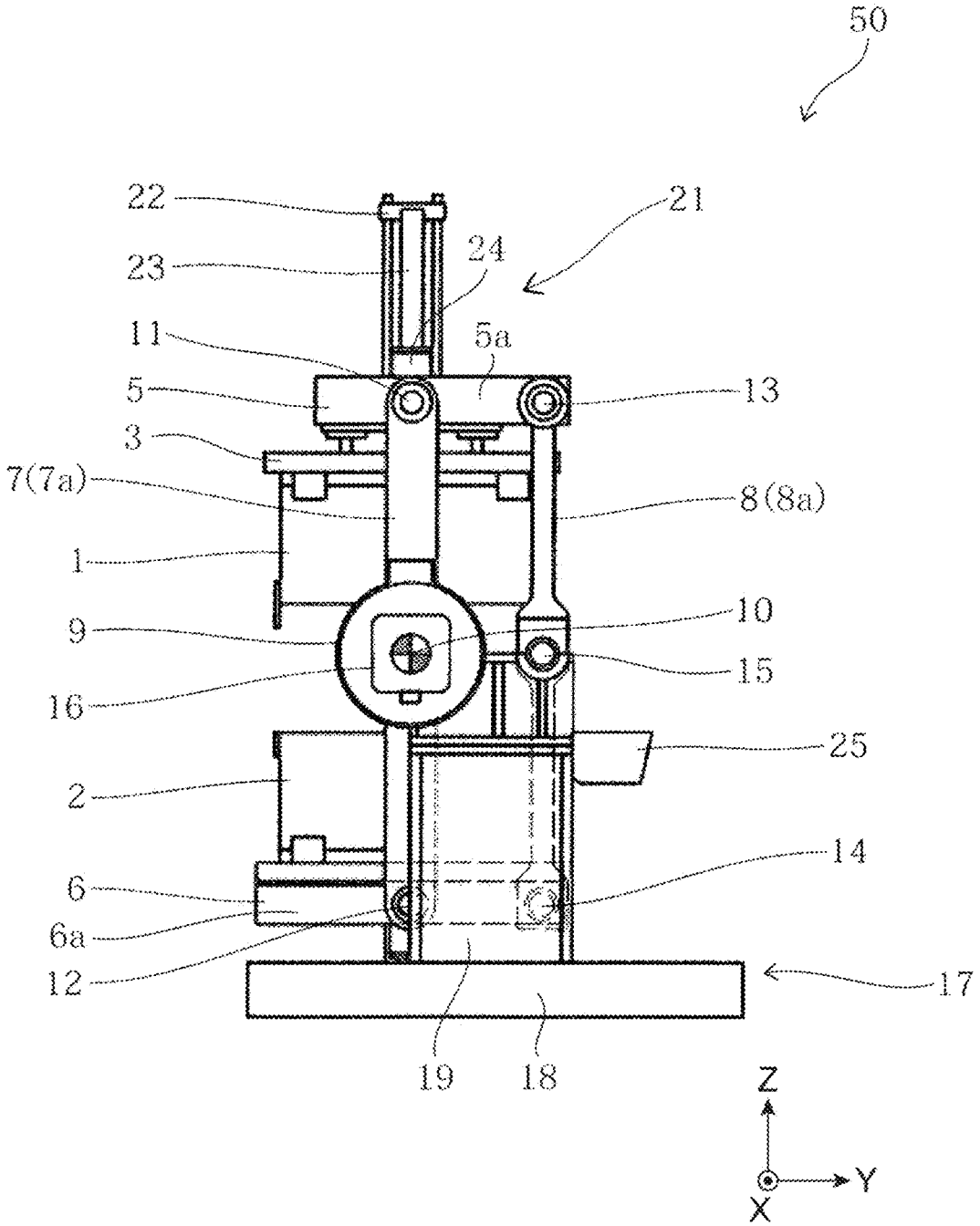
FIG. 2 is a side view of the casting apparatus in FIG. 1.

A configuration of a casting apparatus 50 will be described with reference to FIG. 1 and FIG. 2. FIG. 1 is a front view of a casting apparatus according to a first embodiment. FIG. 2 is a side view of the casting apparatus in FIG. 1. An X direction and a Y direction in the drawings are horizontal directions and a Z direction is a vertical direction. Hereinafter, the X direction will also be referred to as a left-right direction and the Z direction will also be referred to as an up-down direction.

The casting apparatus 50 is a so-called gravity type tilting die casting apparatus into which molten metal is poured using gravity and which forms a casting using an upper mold 1 and a lower mold 2 which can be opened, closed and tilted. The molten metal to be poured can be any material. Examples of the molten metal to be used include aluminum alloy and magnesium alloy. The casting apparatus 50 includes a controller and is configured to be able to control operations of respective components.

As shown in FIG. 1 and FIG. 2, the casting apparatus 50 is provided with, for example, a base frame 17, an upper frame 5, a lower frame 6, an opening/closing mechanism 21, a pair of left and right main link members 7 (first main link member 7*a*, second main link member 7*b*), a pair of left and right sub-link members 8 (first sub-link member 8*a*, second sub-link member 8*b*), a rotation actuator 16 and a ladle 25.

The base frame 17 includes a base 18, a drive side support frame 19 and a driven side support frame 20. The base 18 is a substantially flat plate member composed by combining a plurality of members and is provided horizontally on an installation surface of the casting apparatus 50. The drive side support frame 19 and the driven side support frame 20 are erected on the base 18 in such a way as to face each other in the left-right direction (horizontal direction) and are fixed to the base 18. A pair of tilting rotation bearings 9 is provided at a top end part of the drive side support frame 19 and a top end part of the driven side support frame 20.

The upper frame 5 is disposed above the base frame 17. The upper mold 1 is attached to the upper frame 5. More specifically, the upper mold 1 is mounted on an undersurface of the upper frame 5 via an upper mold die base 3. The upper frame 5 is provided with the opening/closing mechanism 21 moving the upper mold 1 up and down. More specifically, the upper frame 5 incorporates the opening/closing mechanism 21 and holds the upper mold 1 in such a way as to be movable up and down through the opening/closing mechanism 21.

The opening/closing mechanism 21 includes a first actuator 22, a pair of left and right guide rods 23 and a pair of left and right guide cylinders 24. The first actuator 22 moves either the upper mold 1 or the lower mold 2 up and down to thereby open or close the upper mold 1 and the lower mold 2. In the present embodiment, the first actuator 22 moves the upper mold 1 up. A bottom end part of the first actuator 22 is mounted on a top surface of the upper mold die base 3. The first actuator 22 extends in an up-down direction (vertical direction; Z direction here) to thereby move the upper mold 1 down via the upper mold die base 3, and is contracted in the up-down direction to thereby move the upper mold 1 up via the upper mold die base 3. The first actuator 22 may be operated by any one of electric power, hydraulic pressure and pneumatic pressure. An example of the first actuator 22 is a hydraulic cylinder. The guide rods 23 are mounted on the top surface of the upper mold die base 3 through the guide cylinder 24 mounted on the upper frame 5.

The lower frame 6 is disposed above the base frame 17 and below the upper frame 5. The lower mold 2 is attached to the lower frame 6. More specifically, the lower mold 2 is mounted on a top surface of the lower frame 6 via a lower mold die base 4. In the state shown in FIG. 1 and FIG. 2, the upper frame 5 and the lower frame 6 face each other in the up-down direction. Similarly, the upper mold 1 and the lower mold 2 face each other in the up-down direction. The opening/closing mechanism 21 moves the upper mold 1 up and down to thereby close or open the upper mold 1 and the lower mold 2.

The first main link member 7*a* is a long member. The first main link member 7*a* is, for example, a bar-like member having a rectangular cross section. A top end part of the first main link member 7*a* is rotatably connected to the upper frame 5, a bottom end part thereof is rotatably connected to the lower frame 6 and the first main link member 7*a* is provided with a tilt rotating shaft 10 at a central part thereof. The first main link member 7*a* includes a main link upper rotating shaft 11 at the top end part thereof and a main link lower rotating shaft 12 at a bottom end part thereof. In the present embodiment, the first main link member 7*a* is provided with two main link members. The second main link member 7*b* has the same configuration as that of the first main link member 7*a*. The pair of main link members 7 is arranged in such a way as to face each other in the left-right direction (horizontal direction; X direction here) and connect the upper frame 5 and the lower frame 6 respectively. Here, the pair of main link members 7 is arranged in parallel in such a way as to face each other across the upper mold 1 and the lower mold 2.

The central parts of the pair of main link members 7 are rotatably connected to the pair of tilting rotation bearings 9 via the pair of tilt rotating shafts 10. The top end parts of the pair of main link members 7 are rotatably connected to a pair of side faces 5*a* of the upper frame 5 via the pair of main link upper rotating shafts 11. The bottom end parts of the pair of main link members 7 are rotatably connected to a pair of side faces 6*a* of the lower frame 6 via the pair of main link lower rotating shafts 12. When the upper mold 1 and the lower mold 2 are closed, the mounting positions of the pair of main link members 7 with respect to the upper frame 5 and the lower frame 6 are set so that the pair of main link members 7 is located at the respective centers of the upper mold 1 and the lower mold 2 in a depth direction (Y direction) orthogonal to the left-right direction and the up-down direction.

The first sub-link member 8*a* is a long member. The first sub-link member 8*a* is, for example, a bar-like member having a rectangular cross section. The first sub-link member 8*a* is arranged parallel to the first main link member 7*a*, top end parts of which are rotatably connected to the upper frame 5, bottom end parts of which are rotatably connected to the lower frame 6, and is provided with a sub-link central part rotating shaft 15 at a central part thereof. The first sub-link member 8*a* includes a sub-link upper rotating shaft 13 at a top end part thereof and a sub-link lower rotating shaft 14 at a bottom end part thereof. Two sub-link members are provided in the present embodiment. The second sub-link member 8*b* (not shown) has the same configuration as that of the first sub-link member 8*a*. The pair of sub-link members 8 is arranged in such a way as to face each other in the left-right direction, and connect the upper frame 5 and the lower frame 6. The pair of sub-link members 8 is disposed on the pair of side faces 5*a* and the pair of side faces 6*a* in such a way as to be parallel to the pair of main link members 7. The sub-link member 8 has the same length as that of the main link member 7.

The top end parts of the pair of sub-link members 8 are rotatably connected to the pair of side faces 5*a* of the upper frame 5 via the pair of sub-link upper rotating shafts 13. The bottom end parts of the sub-link members 8 are rotatably connected to the pair of side faces 6*a* of the lower frame 6 via a pair of sub-link lower rotating shafts 14. The mounting position of the sub-link member 8 is on a side where the ladle 25 is disposed with respect to the main link member 7. The sub-link central part rotating shaft 15 is placed above the base frame 17. In the state in FIG. 1 and FIG. 2, the sub-link central part rotating shaft 15 is placed on a top surface of the drive side support frame 19.

In this way, the upper frame 5, the lower frame 6, the first main link member 7*a* and the first sub-link member 8*a* constitute a parallel link mechanism (first parallel link mechanism). Similarly, the upper frame 5, the lower frame 6, the second main link member 7*b* and the second sub-link member 8*b* constitute a parallel link mechanism (second parallel link mechanism). The two parallel link mechanisms are arranged in parallel in such a way as to face each other across the upper mold 1 and the lower mold 2.

The tilt rotating shaft 10 of the first main link member 7*a* is held to the base frame 17 by a tilting rotation bearing 9 provided outside the first parallel link mechanism. The center of rotation of the tilt rotating shaft 10 of the first main link member 7*a* coincides with the center of gravity of a rotation body including the closed or opened upper mold 1 and lower mold 2, and the upper frame 5 and the lower frame 6. Similarly, the tilt rotating shaft 10 of the second main link member 7*b* is held to the base frame 17 by the tilting rotation bearing 9 provided outside the second parallel link mechanism. The center of rotation of the tilt rotating shaft 10 of the second main link member 7*b* coincides with the center of gravity of the rotation body including the closed or opened upper mold 1 and lower mold 2, and the upper frame 5 and the lower frame 6. Here, "coincide" is not limited to a case where both coincide completely, but includes a case where errors are contained due to a difference between the weight of the upper mold 1 and the weight of the lower mold 2.

The rotation actuator 16 is disposed above the drive side support frame 19. The rotation actuator 16 is provided in connection with one tilt rotating shaft 10 of the pair of main link members 7. The rotation actuator 16 may be operated by any one of electric motor, hydraulic pressure and pneumatic pressure. An example of the rotation actuator 16 is an electric actuator. An example of the electric actuator is an electric motor such as a servo motor. The rotation actuator 16 functions as a drive unit separating the upper mold 1 from the lower mold 2 in the tilting or horizontal direction.

The upper mold 1 and the lower mold 2 are tilted when the rotation actuator 16 rotates the tilt rotating shaft 10 of the first main link member 7*a* by 45° to 130° with the upper mold 1 and the lower mold 2 closed by the opening/closing mechanism 21. The upper mold 1 is separated from the lower mold 2 in the horizontal direction when the rotation actuator 16 causes the tilt rotating shaft 10 of the first main link member 7*a* to rotate by a predetermined angle with the upper mold 1 and the lower mold 2 closed by the opening/closing mechanism 21. Separation of the upper mold 1 from the lower mold 2 in the horizontal direction is realized by the rotation actuator 16 causing the first parallel link mechanism to act. At this time, the second parallel link mechanism also acts in accordance with the movement of the first parallel link mechanism. Note that the second parallel link mechanism is not essential, but the upper frame 5 and the lower frame 6 may be connected by, for example, only the first parallel link mechanism and the second main link member 7*b*, or the upper frame 5 and the lower frame 6 may be connected by only the first parallel link mechanism and the second sub-link member 8*b*.

The ladle 25 is mounted at a top end part of the side face of the lower mold 2. A storage part for storing molten metal is defined in the ladle 25. A pouring port 25*a* (see FIG. 6) of the ladle 25 is connected to a receiving port 2*a* of the lower mold 2 (see FIG. 6).

Figure 3:
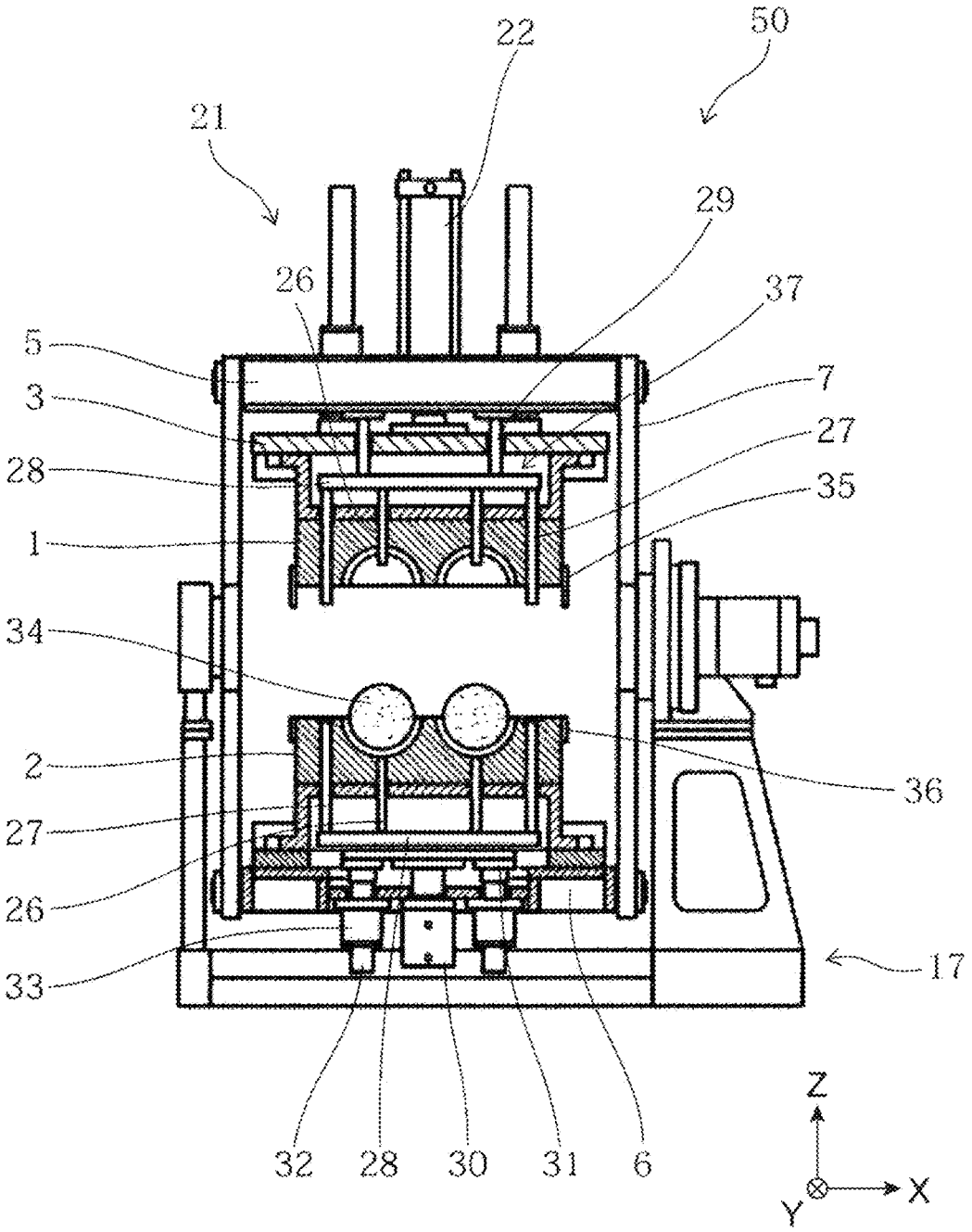
FIG. 3 is a diagram illustrating a cross section of an upper mold and a lower mold in FIG. 1.

FIG. 3 is a diagram illustrating cross sections of the upper mold and the lower mold in FIG. 1. Here, a state is shown in which a plurality of cores 34 are fitted on a top surface of the lower mold 2. As shown in FIG. 3, the casting apparatus 50 is provided with a pushing out mechanism 37 including a pushing out plate 28 (upper pushing out plate), a pair of pushing out pins 26 (upper pushing out pin), a pair of return pins 27 and a plurality of push rods (regulating member) 29. The pushing out mechanism 37 is provided in the upper frame 5.

The pushing out plate 28 is disposed in an inner space formed in the interior on a top end side of the upper mold 1. The pushing out plate 28 is fitted in the inner space in such a way as to be freely movable up and down. Each pushing out pin 26 is provided on an undersurface of the pushing out plate 28. Each pushing out pin 26 moves up and down through a hole from the inner surface of the upper mold 1 to a cavity (upper cavity) in which a casting is formed. Each pushing out pin 26 pushes out the casting in the cavity by a distal end thereof. Each return pin 27 is provided at a position of the pushing out plate 28 different from the pushing out pin 26 of the undersurface. Each return pin 27 moves up and down through the hole from the inner space of the upper mold 1 to an undersurface of the upper mold 1. Each return pin 27 causes the pushing out plate 28 to move up when the distal end of the return pin 27 abuts against the top surface of the lower mold 2 in a process in which the upper mold 1 and the lower mold 2 are closed.

Each push rod 29 is provided on the undersurface of the upper frame 5. Each push rod 29 is disposed on the undersurface of the upper frame 5 by penetrating the upper mold die base 3. The distal end of each push rod 29 is disposed above the pushing out plate 28 into the inner space with each push rod 29 inserted into the hole from the top surface of the upper mold 1 to the inner space. The length of each push rod 29 is set to a length at which the pushing out plate 28 is pushed down when the first actuator 22 is contracted and the upper mold 1 reaches an ascending end. Note that the ascending end is a highest possible position of the upper mold 1 as the first actuator 22 is contracted. That is, each push rod 29 passes through the hole from the top surface of the upper mold 1 into the inner space formed at a position above the upper mold 1 entering the inner space by a predetermined length to thereby prevent the pushing out plate 28 from moving up.

The lower frame 6 incorporates a second actuator 30. The second actuator 30 may be operated by any one of electric motor, hydraulic pressure and pneumatic pressure. An example of the second actuator 30 is a hydraulic cylinder. A top end part of the second actuator 30 is mounted on an undersurface of the pushing out member 31. A pair of left and right guide rods 32 passes through guide cylinders 33 attached to the lower frame 6 and is mounted on the undersurface of the pushing out member 31.

Just like the upper mold 1, the lower mold 2 incorporates the pushing out plate 28 (lower pushing out plate) connecting the pair of pushing out pins 26 (lower pushing out pins) and the pair of return pins 27. There is such a positional relationship in the lower mold 2 that the pushing out member 31 moves up by extending operation of the second actuator 30 to push up the pushing out plate 28 and the pair of pushing out pins 26 and the return pins 27 move up. The distal end of each pushing out pin 26 pushes out a casting in a cavity (lower cavity). Note that the return pins 27 of the upper mold 1 and the lower mold 2 are pushed back at the time of mold closing, by a mating surface of the mold opposite to the distal ends of the return pins 27 or the distal ends of the opposite return pins 27. Accordingly, the pushing out pin 26 connected to the pushing out plate 28 is also pushed back. At the time of mold closing, contraction operation of the second actuator 30 causes the pushing out member 31 to reach a descending end position. Note that the descending end refers to a lowest possible position of the lower mold 2 as the second actuator 30 is contracted.

A pair of positioning keys 35 is mounted in the lower periphery (side face bottom end part) of the upper mold 1. A pair of key grooves 36 is provided in the upper periphery (side face top end part) of the lower mold 2 in such a way as to be engageable with the pair of positioning keys 35. The positioning keys 35 and the key grooves 36 constitute a positioning unit for positioning the upper mold 1 and the lower mold 2 in the horizontal direction. According to this positioning unit, since the upper mold 1 and the lower mold 2 are positioned in the horizontal direction, it is possible to prevent the upper mold 1 and the lower mold 2 from being displaced and closed.

Figure 4:
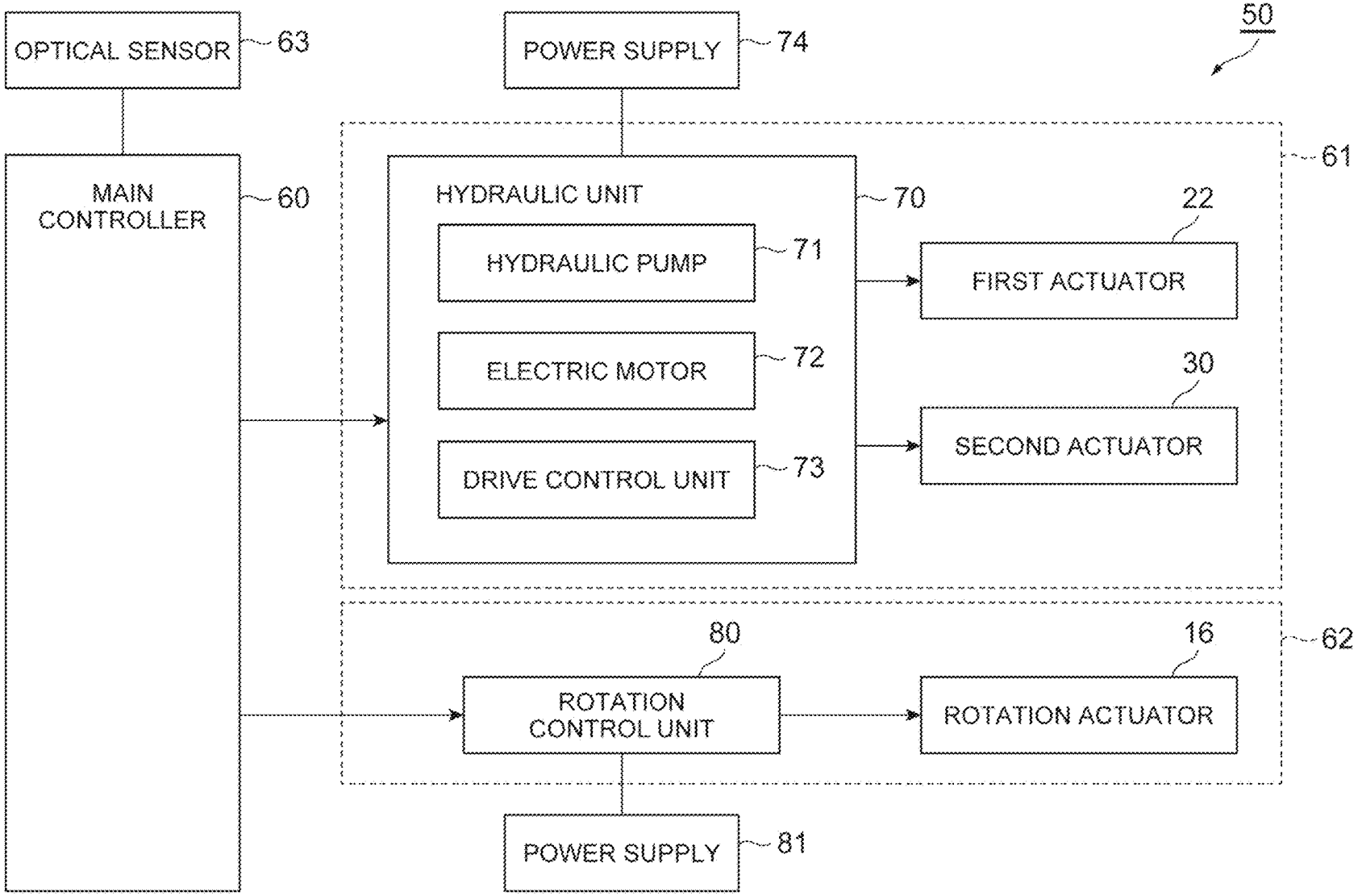
FIG. 4 is a block diagram of a configuration relating to driving of the casting apparatus in FIG. 1.

Next, the configuration relating to driving of the casting apparatus 50 will be described in detail. FIG. 4 is a block diagram of the configuration relating to driving of the casting apparatus 50 in FIG. 1. As shown in FIG. 4, the casting apparatus 50 is provided with a main controller 60 (control unit) and a hydraulic unit 70.

The main controller 60 is hardware controlling the entire driving of the casting apparatus 50. The main controller 60 is constructed of a general-purpose computer including a computation apparatus such as a CPU (Central Processing Unit), a storage apparatus such as a ROM (Read Only Memory), a RAM (Random Access Memory), an HDD (Hard Disk Drive) and a communication apparatus or the like.

The main controller 60 is connected communicably with a first drive unit 61, a second drive unit 62 and an optical sensor 63. The main controller 60 outputs a control signal to the first drive unit 61 and the second drive unit 62 to control driving. The main controller 60 is connected to an operation panel (not shown) such as a touch panel and causes the first drive unit 61 and the second drive unit 62 to operate according to a command operation by an operator received by the operation panel. The main controller 60 can also cause the first drive unit 61 and the second drive unit 62 to operate with reference to a casting recipe stored in the storage apparatus.

The first drive unit 61 causes either the upper mold or the lower mold to move up and down to thereby open or close the upper mold 1 and the lower mold 2. In the present embodiment, the first drive unit 61 causes the upper mold 1 to move up and down to perform mold closing or mold opening. As an example, the first drive unit 61 includes the hydraulic unit 70, the first actuator 22 and the second actuator 30.

The hydraulic unit 70 supplies hydraulic oil to the first actuator 22 and the second actuator 30. The hydraulic unit 70 is provided with a hydraulic circuit. The hydraulic circuit is a channel that circulates hydraulic oil of the hydraulic actuator. The hydraulic circuit includes a hydraulic pump 71 (first hydraulic pump), an electric motor 72 (first pump electric motor), a solenoid valve (not shown), an oil tank (not shown) or the like. The hydraulic circuit supplies the hydraulic oil stored in the oil tank to the first actuator 22 and the second actuator 30. The hydraulic circuit collects the hydraulic oil from the first actuator 22 and the second actuator 30 and returns the hydraulic oil to the oil tank. In this way, the hydraulic circuit can circulate the hydraulic oil.

The hydraulic pump 71 suctions the hydraulic oil in the oil tank and supplies the hydraulic oil to the first actuator 22 and the second actuator 30. The electric motor 72 is a device driving the hydraulic pump and is, for example, a variable speed motor. The hydraulic oil is carried from the hydraulic pump according to the number of revolutions of the electric motor 72. A discharge flow rate of the hydraulic pump is calculated by multiplying the number of revolutions of the electric motor 72 by the volume of the hydraulic pump.

The hydraulic unit 70 is provided with a drive control unit 73 (first drive control unit) controlling the number of revolutions of the electric motor 72. The drive control unit 73 is a device controlling the number of revolutions of the electric motor 72. The drive control unit 73 includes a converter circuit that converts AC to DC and an inverter circuit that performs inverter control. The inverter circuit controls ON/OFF operation of a switching element provided for the inverter circuit. As an example, the drive control unit 73 receives the number of revolutions (rotation speed) of the electric motor 72 detected by a number of revolutions sensor (not shown) and a target number of revolutions (target rotation speed) as input, performs proportional integration (PI) control, and thereby generates a current command value. The drive control unit 73 generates a control signal to perform ON/OFF operation of the switching element based on the current command value and outputs the control signal to the inverter circuit. The electric motor 72 is thereby controlled in such a way as to operate at a predetermined number of revolutions at predetermined timing.

The first drive unit 61 is connected to a power supply 74 and operates with power supplied from the power supply 74. By outputting a control signal, the main controller 60 can shut off the power supply 74 from the first drive unit 61. "Shutting off" means electrically shutting off a connection.

The second drive unit 62 causes the upper mold 1 and the lower mold 2 closed by the first drive unit 61 to tilt. The second drive unit 62 includes, for example, a rotation control unit 80 (second electric control unit) and the rotation actuator 16. The rotation control unit 80 outputs a control signal to the rotation actuator 16 based on the control signal of the main controller 60 and performs position control of the rotation actuator 16. The "position control" refers to controlling the angle of rotation and the rotation speed of the rotation actuator 16 by a control signal. When the rotation actuator 16 is an electric motor, power is not supplied when the rotation actuator 16 is not driving.

The second drive unit 62 is connected to a power supply 81 and operates with power supplied from the power supply 81. By outputting a control signal, the main controller 60 can shut off the power supply 81 from the second drive unit 62. "Shutting off" means electrically shutting off a connection.

The optical sensor 63 is a detector using light. The optical sensor 63 is disposed in the periphery of the casting apparatus 50 and detects an object. Details of the mounting position of the optical sensor 63 will be described later. The optical sensor 63 includes a light projecting unit and a light receiving unit. The optical sensor 63 detects, for example, that an operator passes between the light projecting unit and the light receiving unit. A specific example of the optical sensor 63 is a light curtain. The optical sensor 63 outputs the detection result to the main controller 60.

When an object is detected by the optical sensor 63, the main controller 60 shuts off the power supplies 74 and 81 of the first drive unit 61 and the second drive unit 62. This causes the first drive unit 61 and the second drive unit 62 to lose power sources and stop operating. At this time, energy accumulated in the first drive unit 61 and the second drive unit 62 is released according to a predetermined procedure.

The main controller 60 performs an exceptional operation during a predetermined casting period. The "predetermined casting period" refers to a period after molten metal is supplied to the upper mold 1 and the lower mold 2 tilted by the second drive unit 62 until the molten metal is cooled. Supply start timing of the molten metal is, for example, timing at which a tilt start button is pressed. Alternatively, the supply start timing of the molten metal is timing at which the main controller 60 outputs a control signal for tilt start is outputted to the second drive unit 62. Cooling ending timing of the molten metal is, for example, when a predetermined time has passed after start timing of pouring the molten metal. Alternatively, the cooling ending timing of the molten metal is timing at which temperature falls to or below a predetermined temperature based on the detection result by a sensor (not shown) detecting temperatures of the upper mold 1 and the lower mold.

During a predetermined casting period, if the first drive unit 61 is completely stopped, mold opening may occur before the molten metal hardens sufficiently and the molten metal may flow out of the metal die. During the predetermined casting period, if the second drive unit 62 is completely stopped, torque by the second drive unit may be released, the tilting position cannot be kept and pouring of the molten metal may be suspended. In this case, the molten metal may coagulate without a sufficient amount of molten metal being poured. When an insufficient amount of molten metal coagulates, the pushing out pin 26 may not be able to reach the casting. If such an event occurs, the operator may have to remove the casting from the metal die using a burner or the like. As described above, when the first drive unit 61 and the second drive unit 62 have completely stopped during the predetermined casting period, there is a risk of requiring considerable time for restoration.

For this reason, when the optical sensor 63 detects an object for the predetermined casting period, the main controller 60 does not shut off the power supply 74 of the first drive unit 61 and the second drive unit 62, but causes the first drive unit 61 to continue mold closing and causes the second drive unit 62 to keep the tilting position. In this way, the casting apparatus 50 can be speedily restored even when it is stopped in emergency.

Figure 5:
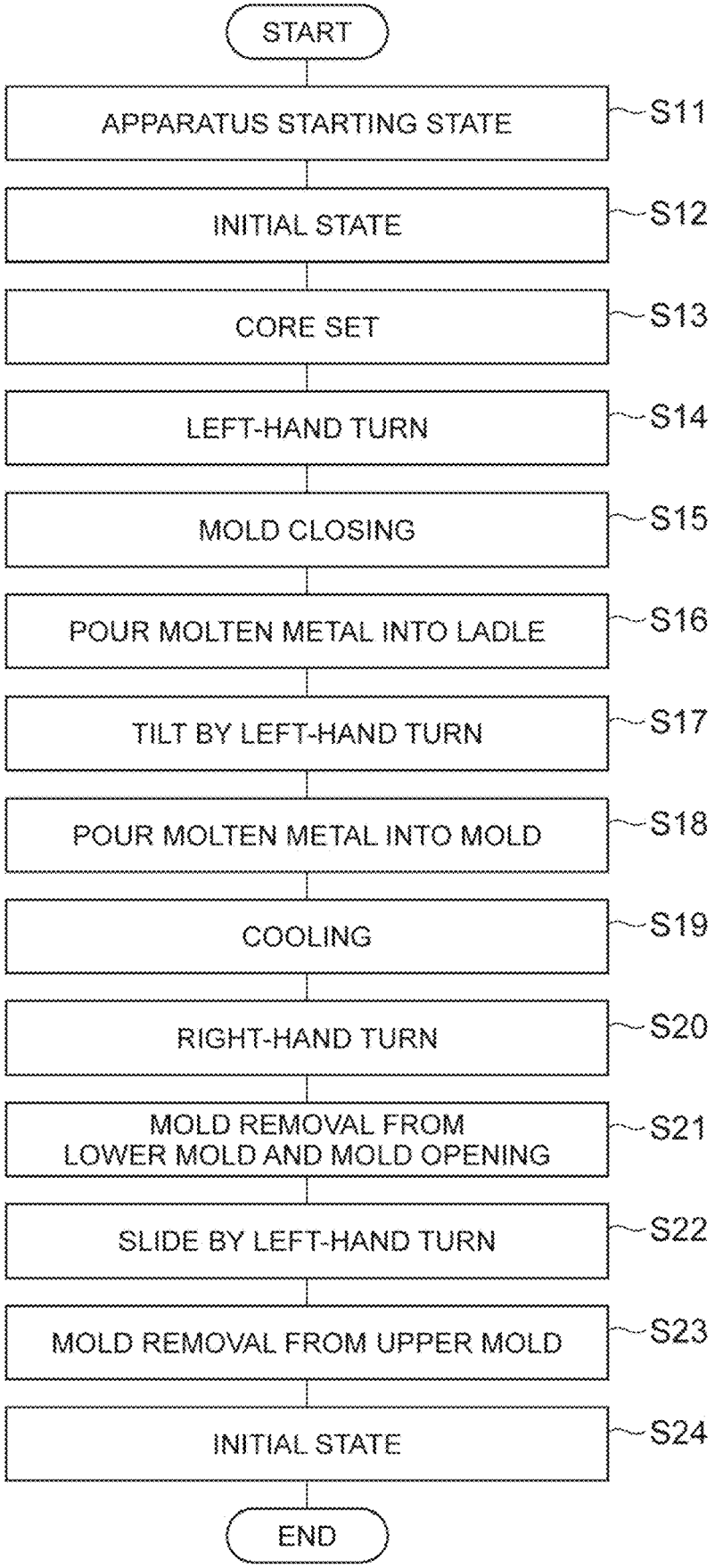
FIG. 5 is a flowchart illustrating a casting method by the casting apparatus in FIG. 1.
Figure 6:
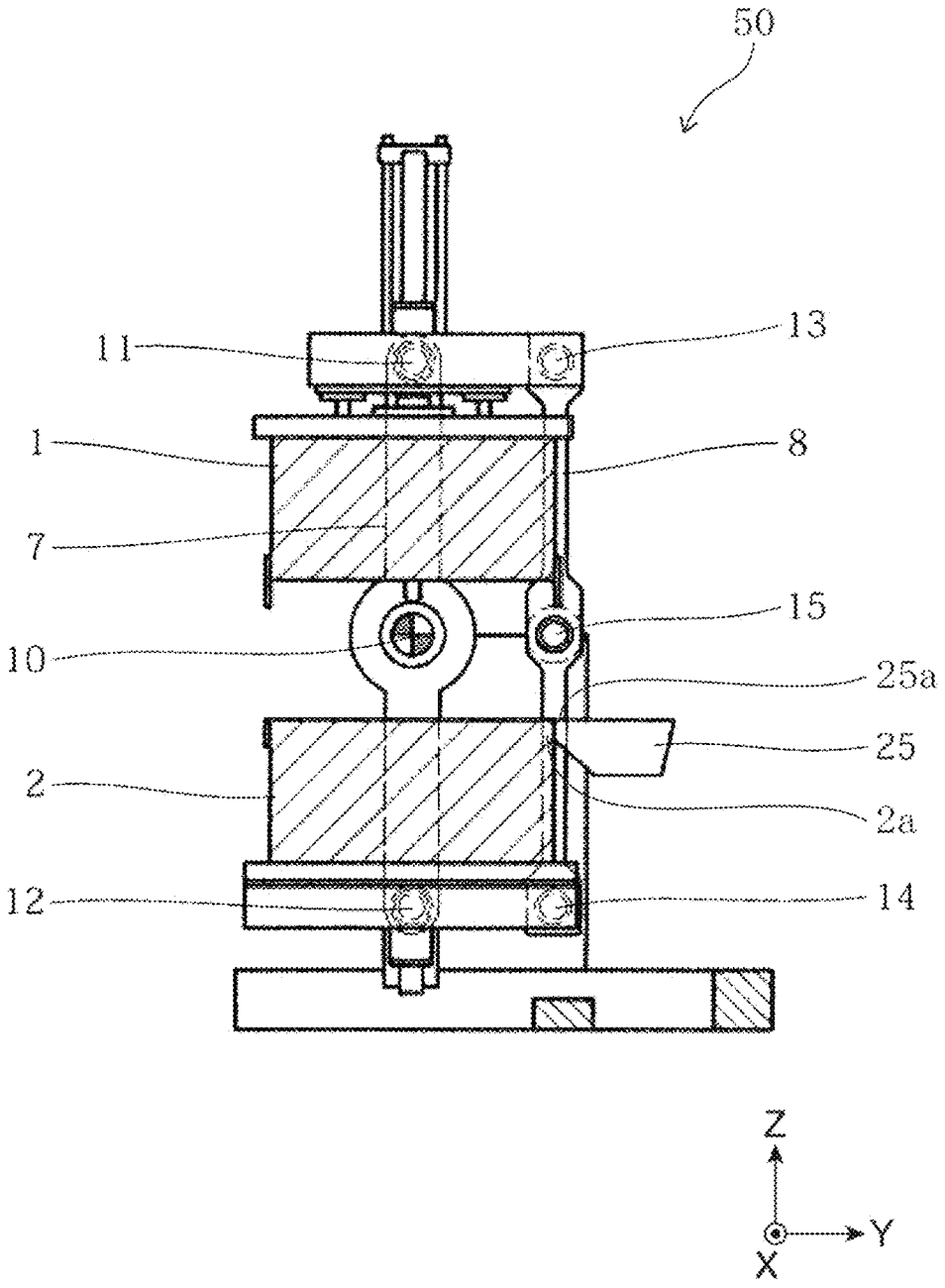
FIG. 6 is a diagram viewed from an arrow direction of a line A-A in FIG. 1 and for describing an apparatus starting state.
Figure 7:
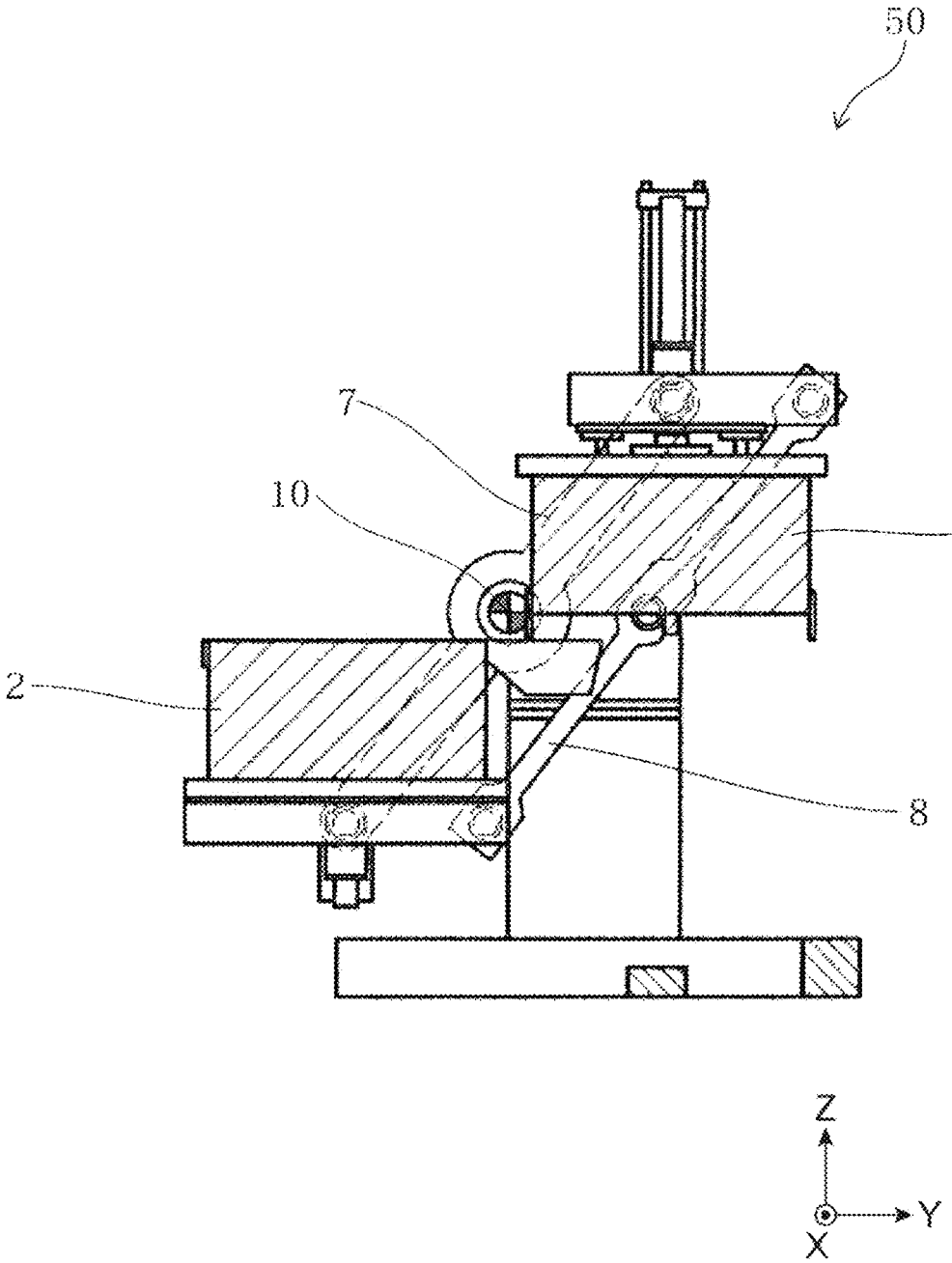
FIG. 7 is a diagram illustrating a second separate state in which upper and lower molds are slid through operation of a parallel link mechanism and describing an initial state of a manufacturing step.
Figure 8:
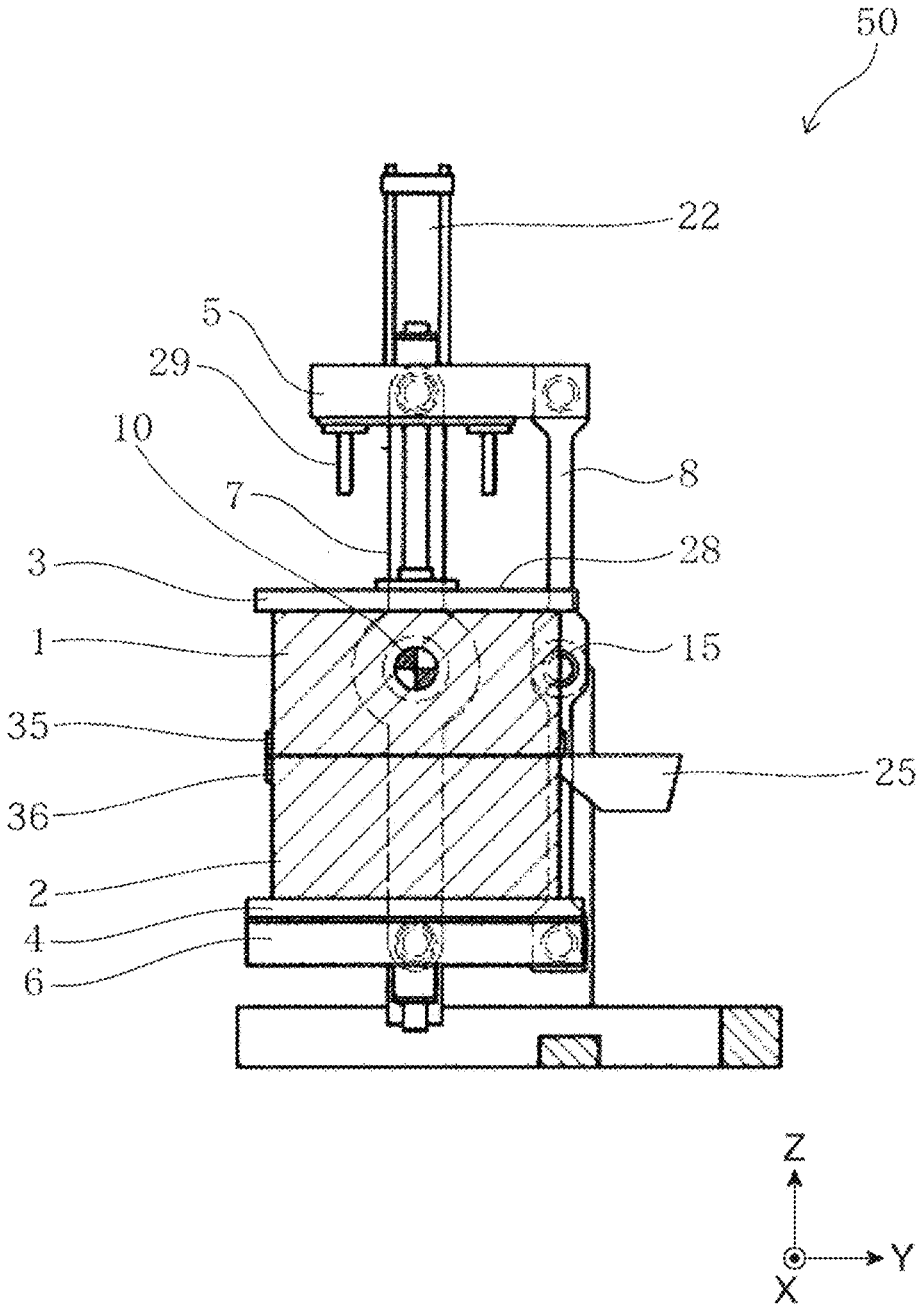
FIG. 8 is a diagram for describing a mold closed state in which the upper mold and the lower mold are closed.
Figure 9:
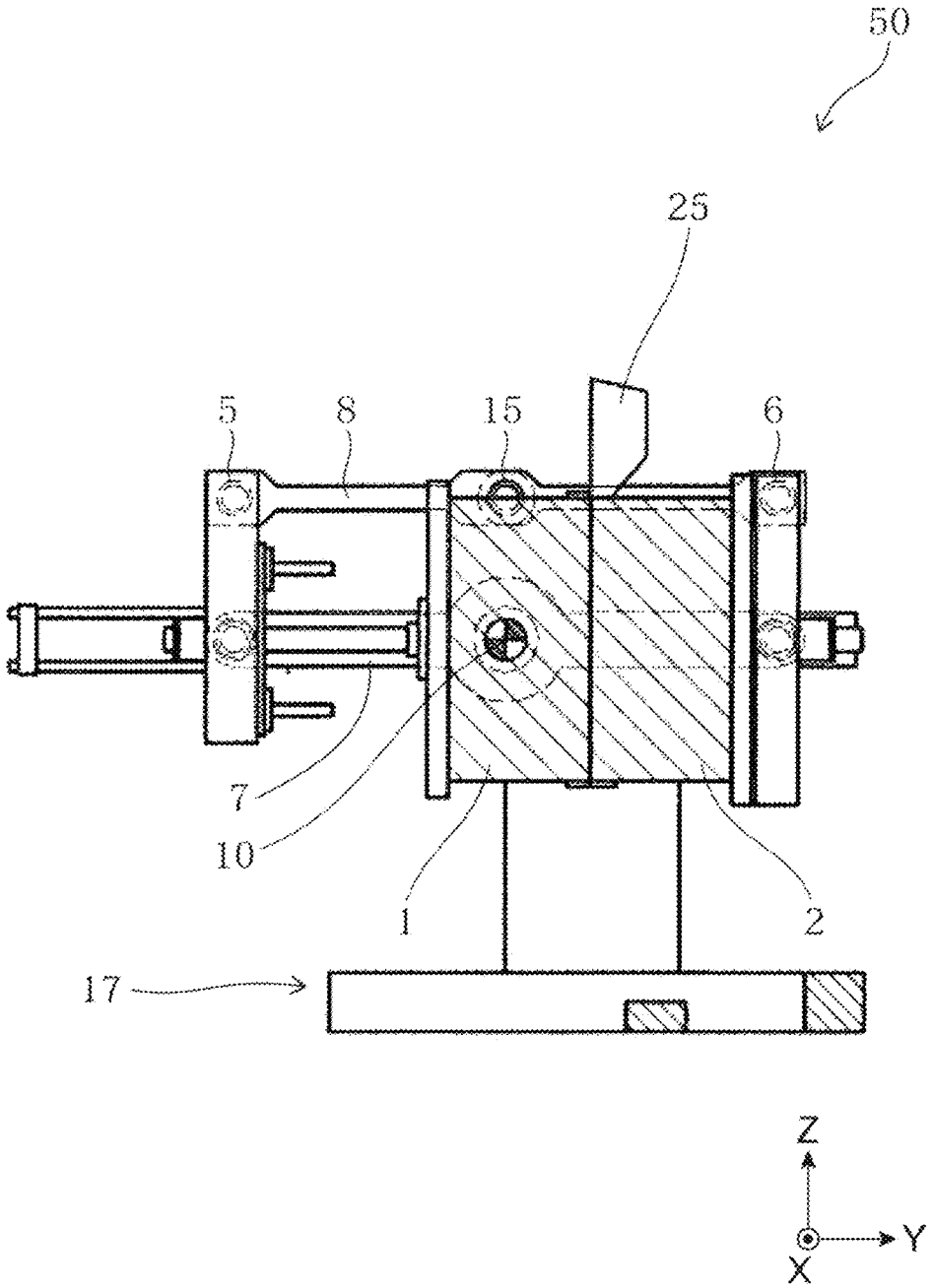
FIG. 9 is a diagram in which the closed upper mold and lower mold are turned by 90°.
Figure 10:
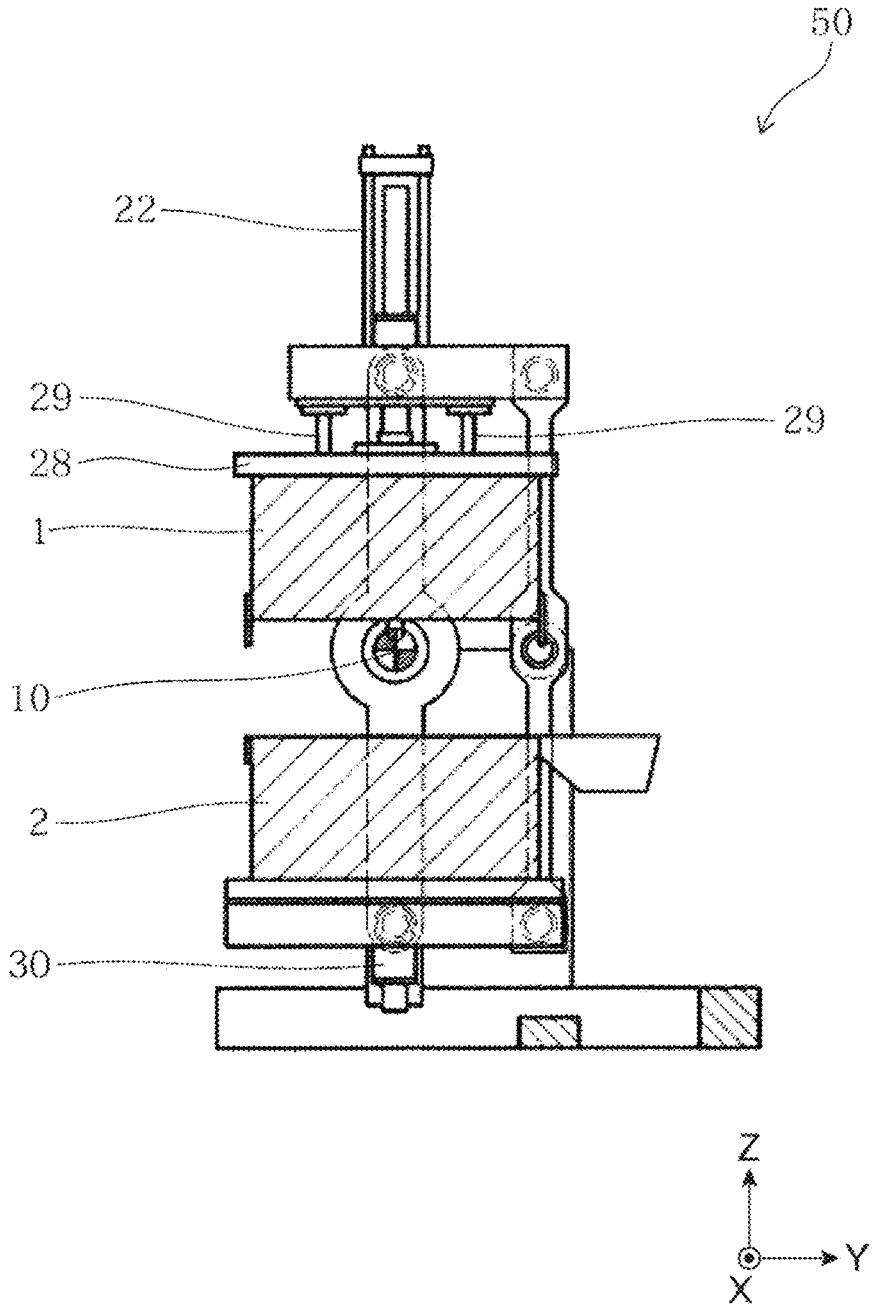
FIG. 10 is a diagram illustrating the upper mold raised up to a midway position.
Figure 11:
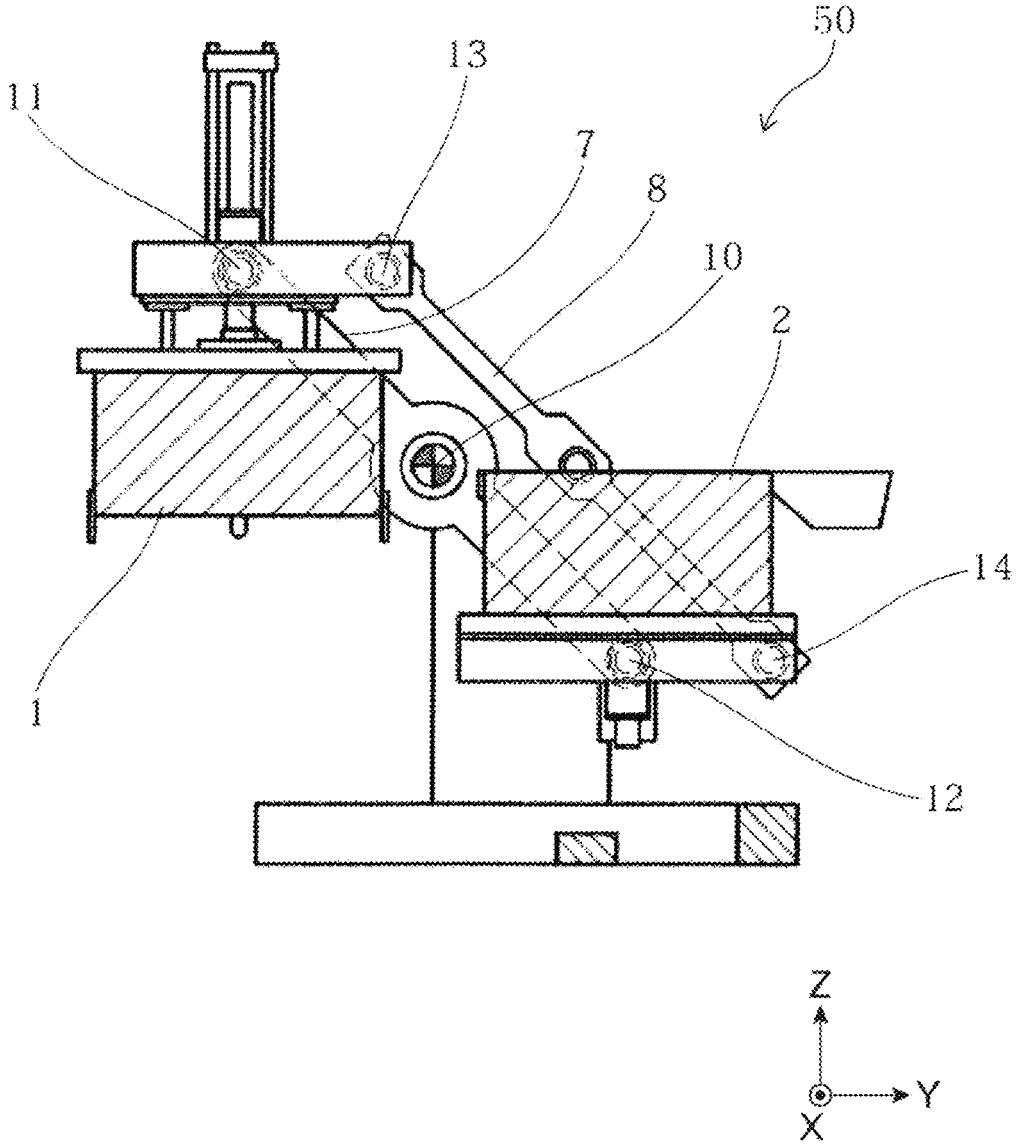
FIG. 11 is a diagram illustrating the upper mold and the lower mold slid into a first separate state.
Figure 12:
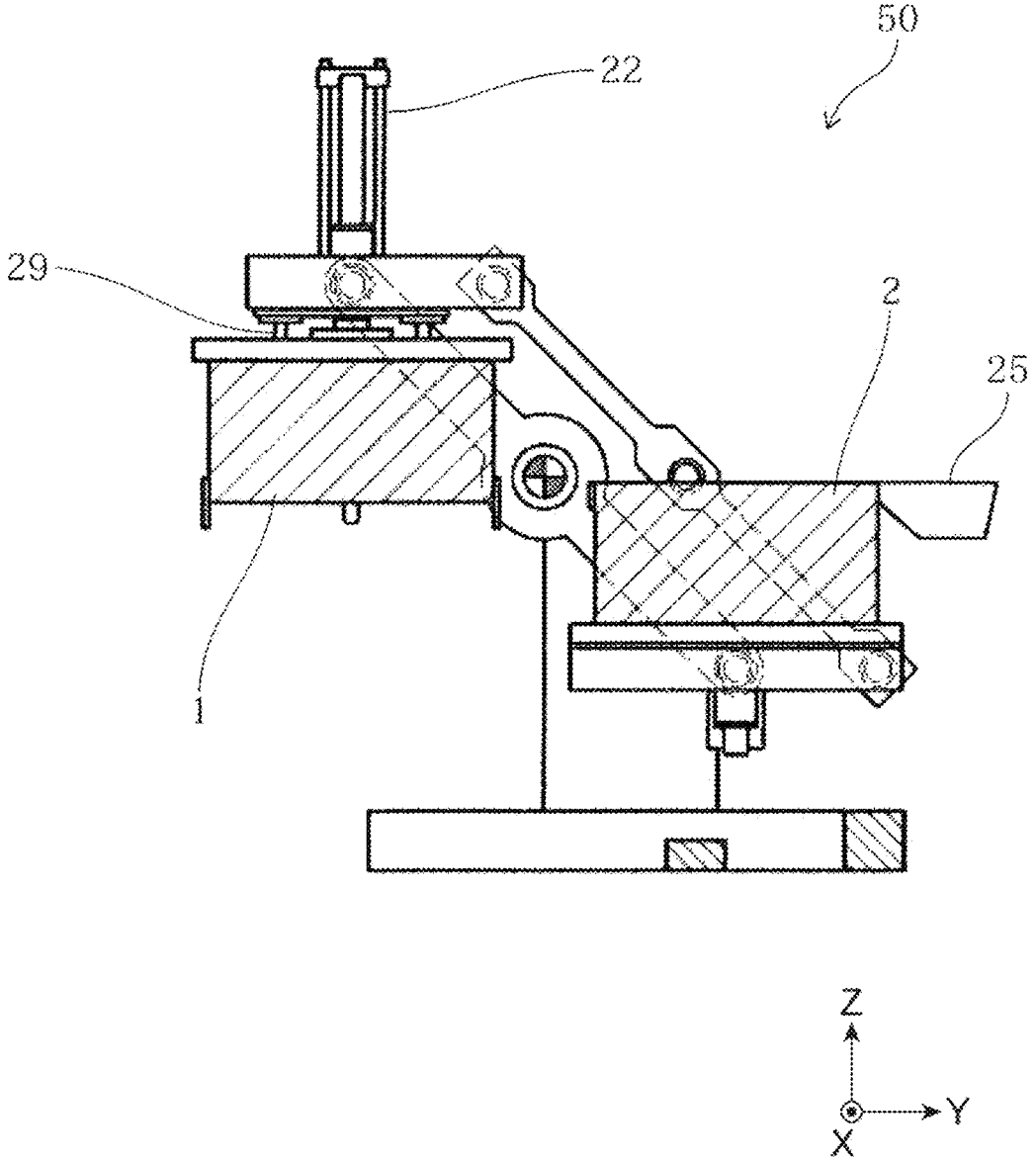
FIG. 12 is a diagram illustrating the upper mold raised from the state in FIG. 11 up to an ascending end.

Next, an example of the casting method by the casting apparatus 50 will be described with reference to FIG. 5 to FIG. 12. FIG. 5 is a flowchart illustrating the casting method by the casting apparatus in FIG. 1. FIG. 6 is a diagram viewed from an arrow direction of a line A-A in FIG. 1 and for describing an apparatus starting state. FIG. 7 is a diagram illustrating a second separate state in which the upper and lower molds are slid through operation of a parallel link mechanism and describing an initial state of a manufacturing step. FIG. 8 is a diagram for describing a mold closed state in which the upper mold and the lower mold are closed. FIG. 9 is a diagram in which the closed upper mold and lower mold are turned by 90°. FIG. 10 is a diagram illustrating the upper mold raised up to a midway position. FIG. 11 is a diagram illustrating the upper mold and the lower mold slid into a first separate state. FIG. 12 is a diagram illustrating the upper mold raised up to an ascending end from the state in FIG. 11.

As shown in FIG. 5 and FIG. 6, at the start of power supply, the upper mold 1 of the casting apparatus 50 is at an ascending end and the pair of main link members 7 and the pair of sub-link members 8 are perpendicular to the installation surface of the casting apparatus 50 (apparatus starting state: step S11). In step S11, the main power supply of the casting apparatus 50 is turned ON and the first drive unit 61 is connected to the power supply 74 in a conduction-enabled state. The electric motor 72 of the first drive unit 61 starts operation under the control of the main controller 60. The second drive unit 62 is connected to the power supply 81 in a conduction-enabled state.

Note that the casting apparatus 50 is disposed between a workspace (not shown) and a pouring apparatus (not shown). The casting apparatus 50 is disposed such that the ladle 25 faces the workspace (not shown) in the Y direction. The workspace is a space for the operator to perform a core fitting operation or the like. The pouring apparatus is an apparatus that pours molten metal into the ladle 25. For example, a conveyor (not shown) is disposed between the casting apparatus 50 and the workspace. The conveyor is an apparatus that carries a casting (cast product) cast by the casting apparatus 50. The conveyor extends up to an apparatus in a post-process (e.g., product cooling apparatus, sand shakeout apparatus, product finishing apparatus or the like).

Next, as shown in FIG. 5 and FIG. 7, the casting apparatus 50 is placed into an initial state of a series of casting processes (step S12). The casting apparatus 50 is changed from the state shown in FIG. 6 to an initial state shown in FIG. 7. The main controller 60 of the casting apparatus 50 outputs a control signal to drive the rotation actuator 16. In this way, the rotation actuator 16 is supplied with power and driven according to a command.

When the rotation actuator 16 is driven, the tilt rotating shaft 10 of the first main link member 7*a* turns clockwise. In the present embodiment, a turn in the clockwise direction is assumed to be a right-hand turn and the opposite turn is assumed to be a left-hand turn. Accordingly, the upper mold 1 and the lower mold 2 slide in an arc in opposite directions through action of the parallel link mechanism. More specifically, when the mutually opposing upper mold 1 and lower mold 2 make circular motion of right-hand turn around the tilt rotating shaft 10 as a central axis, and the upper mold 1 and the lower mold 2 move away from each other in the horizontal direction. At this time, the upper mold 1 has moved to the pouring apparatus side (second separate state). This second separate state is an initial state of a series of casting steps. In the present embodiment, the state in which the lower mold 2 has moved to the pouring apparatus side is assumed to be a first separate state and the state in which the upper mold 1 has moved to the pouring apparatus side is assumed to be a second separate state. That is, the first separate state (see FIG. 11) is a state in which the rotation actuator 16 causes the upper mold 1 to move in a direction away from the pouring apparatus and the lower mold 2 moves in a direction approaching the pouring apparatus, whereby the upper mold 1 and the lower mold 2 remain separate from each other in the horizontal direction. The second separate state (see FIG. 7) is a state in which the rotation actuator 16 causes the upper mold 1 to move in the direction approaching the pouring apparatus and the lower mold 2 moves in a direction away from the pouring apparatus, whereby the upper mold 1 and the lower mold 2 remain separate from each other in the horizontal direction.

Next, the core 34 is fitted in a predetermined position of the lower mold 2 (step S13). Fitting of the core 34 is performed by, for example, the operator. The core 34 is molded using, for example, a core molding machine (not shown). In the second separate state, the lower mold 2 is open upward in which the ladle 25 mounted on the lower mold 2 is not in contact with the upper mold 1. Since the lower mold 2 is open upward in this way, the core 34 can be fitted in the lower mold 2 safely.

Next, the casting apparatus 50 causes the rotation actuator 16 to drive the tilt rotating shaft 10 of the first main link member 7*a* to turn counterclockwise and then return to the apparatus starting state in FIG. 6 (step S14). The main controller 60 of the casting apparatus 50 outputs a control signal to drive the rotation actuator 16. In this way, the rotation actuator 16 is supplied with power and driven according to a command.

Next, as shown in FIG. 5 and FIG. 8, the casting apparatus 50 causes the first actuator 22 to extend to close the upper mold 1 and the lower mold 2 (step S15). The hydraulic unit 70 supplies hydraulic oil to the first actuator 22. This causes the first actuator 22 to extend. At this time, the positioning key 35 of the upper mold 1 engages with the key groove 36 of the lower mold 2, and the upper mold 1 and the lower mold 2 are fixed in the horizontal direction. Furthermore, mold closing prevents rotations of the pair of main link members 7 and the pair of sub-link members 8, the main link upper rotating shaft 11, the main link lower rotating shaft 12, the sub-link upper rotating shaft 13 and the sub-link lower rotating shaft 14, which integrates the upper mold 1, the lower mold 2, the upper frame 5, the lower frame 6, the pair of main link members 7 and the pair of sub-link members 8 together.

Next, when the upper mold 1 and the lower mold 2 are closed, that is, in a mold-closed state, the pouring apparatus supplies molten metal into the ladle 25 (step S16). Next, as shown in FIG. 5 and FIG. 9, the casting apparatus 50 causes the rotation actuator 16 to drive the tilt rotating shaft 10 of the first main link member 7*a* to turn counterclockwise by approximately 90° to bring the upper mold 1 and the lower mold 2 into a tilted state (step S17: start of casting period). The main controller 60 of the casting apparatus 50 outputs a control signal to drive the rotation actuator 16. In this way, the rotation actuator 16 is supplied with power and driven according to a command. The sub-link central part rotating shaft 15 is thereby raised from the top surface of the base frame 17 on which it had been placed. Accordingly, the closed and integrated upper mold 1, lower mold 2, upper frame 5, lower frame 6, pair of main link members 7 and pair of sub-link members 8 rotate and the molten metal in the ladle 25 is tilted and poured into the cavity formed between the upper mold 1 and the lower mold 2 (step S18).

After the process in above step S18 ends, the state in FIG. 9 is kept for a predetermined time, waiting for the poured molten metal to coagulate (cool) (step S19: end of casting period). Note that as described above, the rotation actuator 16 is caused to drive the tilt rotating shaft 10 of the first main link member 7*a* to turn counterclockwise by approximately 90°, but the tilt rotating shaft 10 may also be caused to turn by a predetermined angle within a range of 45° to 130° or 45° to 90°.

Next, the main controller 60 of the casting apparatus 50 causes the rotation actuator 16 to drive the tilt rotating shaft 10 of the first main link member 7*a* to turn clockwise and return to the state in FIG. 8 (step S20). The main controller 60 of the casting apparatus 50 outputs a control signal to drive the rotation actuator 16. In this way, the rotation actuator 16 is supplied with power and driven according to a command.

Next, mold removal and mold opening from the lower mold 2 are simultaneously performed (step S21). Mold opening is performed as shown in FIG. 5 and FIG. 10 and mold removal from the lower mold 2 is also performed simultaneously. Mold opening is started by the casting apparatus 50 operating the first actuator 22. The hydraulic unit 70 supplies hydraulic oil to the first actuator 22 in reverse direction. This causes the first actuator 22 to contract and causes the upper mold 1 to move up. Mold opening of the upper mold 1 and the lower mold 2 starts in this way. Extending operation of the second actuator 30 starts simultaneously with the contracting operation of the first actuator 22. That is, the hydraulic unit 70 also supplies hydraulic oil to the second actuator 30. When the second actuator 30 extends, the pushing out pin 26 (see FIG. 3) incorporated in the lower mold 2 is pushed out. This causes the casting (not shown) consisting of coagulated molten metal in the upper mold 1 and the lower mold 2 to be removed from the lower mold 2 and remain held to the upper mold 1. The casting apparatus 50 causes the upper mold 1 to move up to a predetermined position and mold opening is completed. The predetermined position is a position where the distal end of the push rod 29 is not in contact with the top surface of the pushing out plate 28 of the upper mold 1. In other words, the predetermined position is a position where there is a gap between the distal end of the push rod 29 and the top surface of the pushing out plate 28 of the upper mold 1.

Next, as shown in FIG. 5 and FIG. 11, the casting apparatus 50 causes the rotation actuator 16 to drive the tilt rotating shaft 10 of the first main link member 7*a* to turn counterclockwise (step S22). The main controller 60 of the casting apparatus 50 outputs a control signal to drive the rotation actuator 16. In this way, the rotation actuator 16 is supplied with power and driven according to a command. Through the action of the parallel link mechanism, the casting apparatus 50 causes the upper mold 1 and the lower mold 2 to slide in an arc and separates them apart in the horizontal direction. At this time, a state in which the upper mold 1 has moved to the conveyor side, that is, a first separate state in which the lower mold 2 has moved in a direction approaching the pouring apparatus. The angle of left-hand turn of the rotation actuator 16 at this time becomes on the order of 30° to 45° at which the upper mold 1 is opened downward.

Next, as shown in FIG. 5 and FIG. 12, the casting apparatus 50 contracts the first actuator 22 to move the upper mold 1 up to an ascending end. The hydraulic unit 70 supplies hydraulic oil to the first actuator 22 in a reverse direction. When the hydraulic oil is supplied, the first actuator 22 extends. In this way, the distal end of the push rod 29 relatively pushes out the pushing out pin 26 (see FIG. 6) with respect to the upper mold 1 via the pushing out plate 28 incorporated in the upper mold 1. As a result, the casting held to the upper mold 1 is removed from the upper mold 1 (step S23). The casting removed from the upper mold 1 drops and is received by the conveyor provided below the upper mold 1. That is, the conveyor functions as a receiver receiving the casting as well. After that, the casting is carried by the conveyor to, for example, a product cooling apparatus, a sand shakeout apparatus and a product finishing apparatus carrying out deburring or the like.

Next, as shown in FIG. 5, the casting apparatus 50 causes the rotation actuator 16 to drive the tilt rotating shaft 10 of the first main link member 7*a* to turn clockwise (step S22). The main controller 60 of the casting apparatus 50 outputs a control signal to drive the rotation actuator 16. The rotation actuator 16 is supplied with power and driven according to a command. In this way, the casting apparatus 50 returns to the initial state (FIG. 7). As described above, a series of casting processes are completed and a casting is cast by the casting apparatus 50. When the casting processes are consecutively performed, castings can be cast consecutively by repeating processes from the core setting process in step S13.

Figure 13:
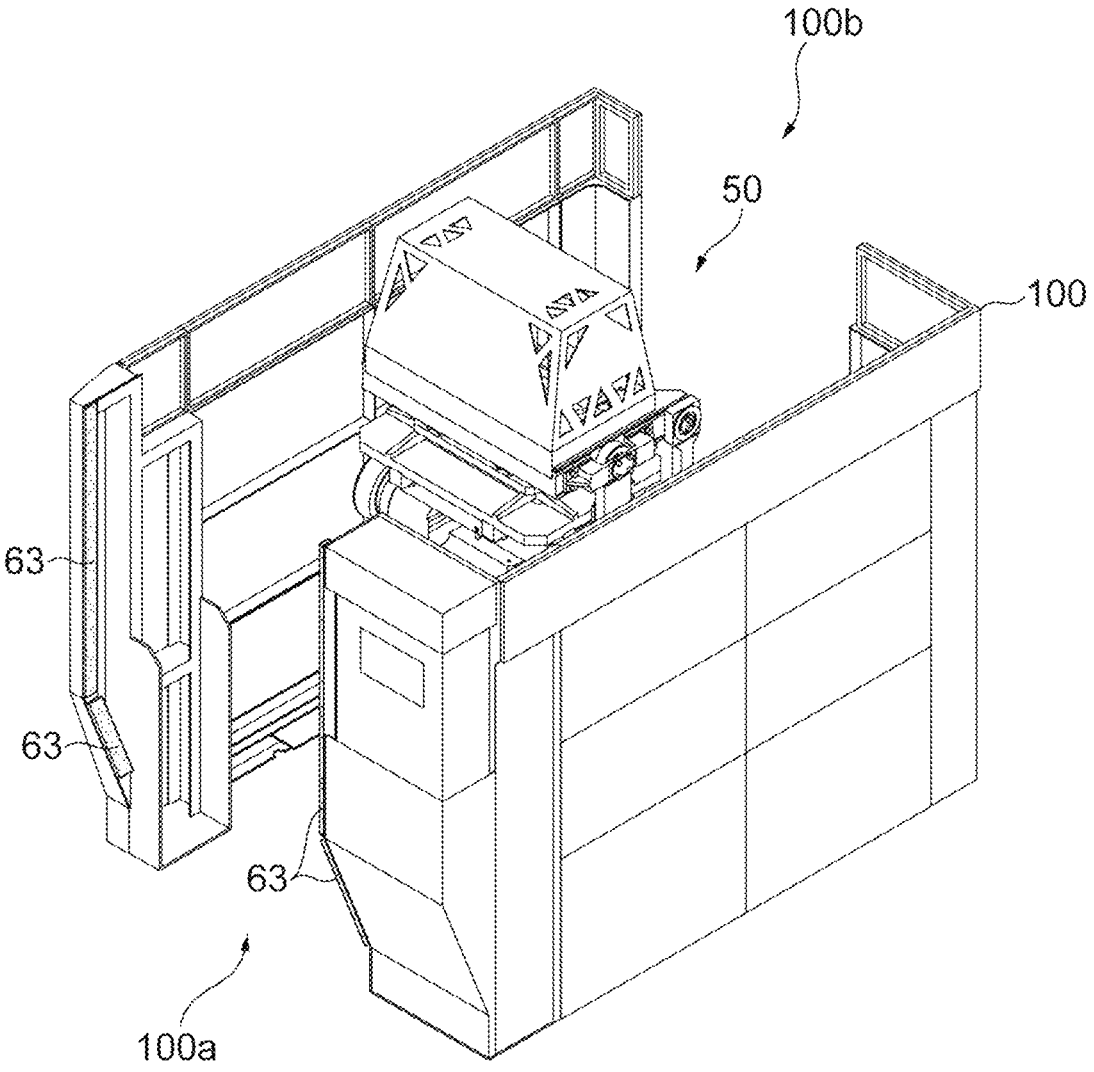
FIG. 13 is a perspective view illustrating a mounting position of an optical sensor of the casting apparatus.

Next, the emergency stop method for the casting apparatus 50 will be described. First, the mounting position of the optical sensor 63 will be described. FIG. 13 is a perspective view illustrating a mounting position of the optical sensor of the casting apparatus. As shown in FIG. 13, two fixed type guards 100 are provided in the periphery of the casting apparatus 50 in such a way as to face each other across the casting apparatus 50. The two fixed type guards 100 are arranged on sides of the casting apparatus 50. For this reason, the front and the rear of the casting apparatus 50 are accessible. The operator passes through an entrance 100*a* on the front of the casting apparatus 50 to set the cores or the like. The pouring apparatus passes through an entrance 100*b* on the rear side of the casting apparatus 50 for pouring operation. The optical sensor 63 is provided at the entrance 100*a* on the front of the casting apparatus 50. The optical sensor 63 detects that the operator goes in the entrance 100*a* on the front of the casting apparatus 50.

Figure 14:
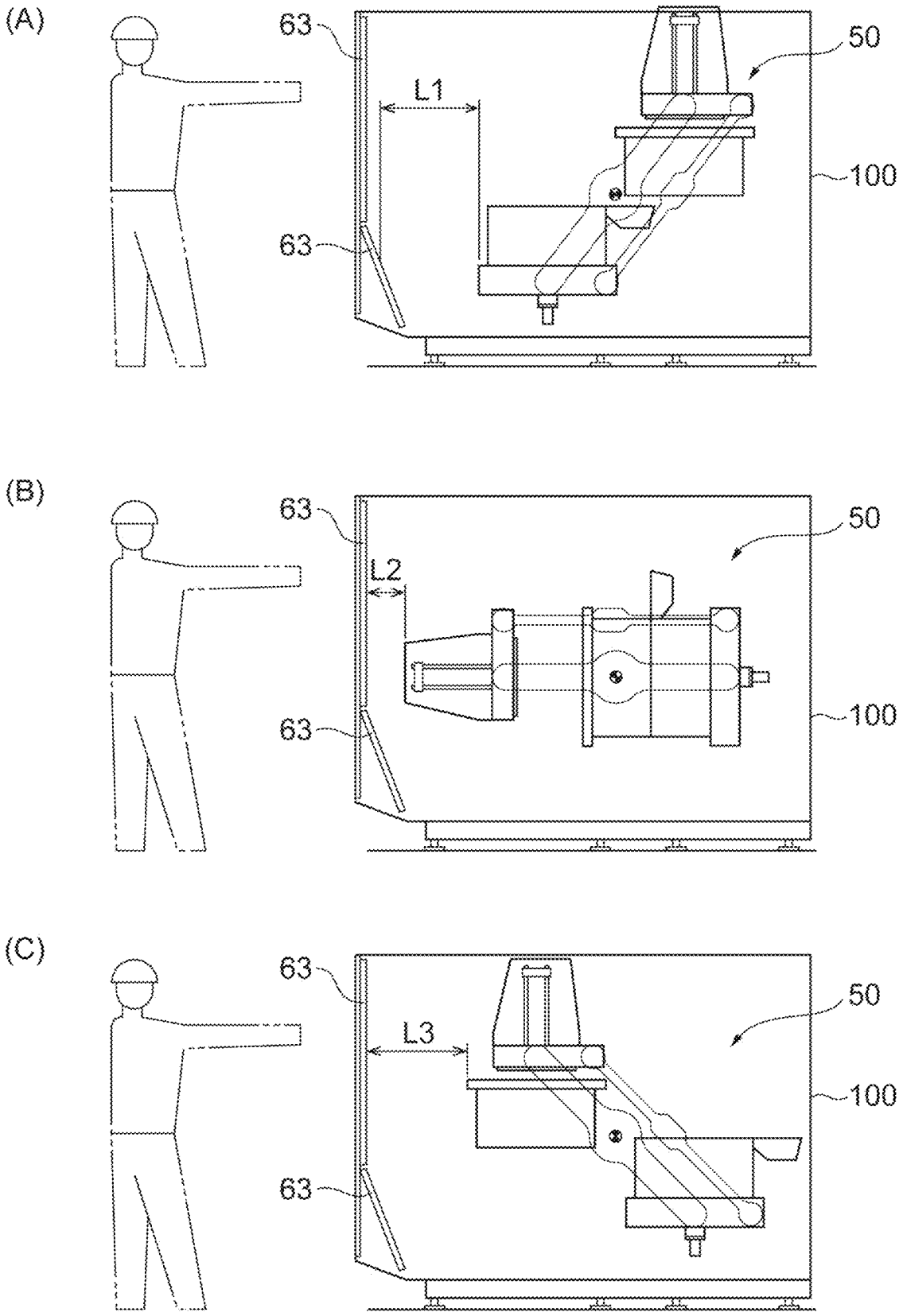
FIG. 14 is a schematic view illustrating the mounting position of the optical sensor of the casting apparatus.

FIG. 14 is a schematic view illustrating the mounting position of the optical sensor of the casting apparatus. As shown by a state A in FIG. 14, when the casting apparatus 50 is in a second separate state, there is a first distance L1 between the optical sensor 63 and the casting apparatus 50. As shown by a state B in FIG. 14, when the casting apparatus 50 is in a tilting state, there is a second distance L2 between the optical sensor 63 and the casting apparatus 50. As shown by a state C in FIG. 14, when the casting apparatus 50 is in a first separate state, there is a third distance L3 between the optical sensor 63 and the casting apparatus 50. The first distance L1, the second distance L2 and the third distance L3 are set in such a way as to prevent the casting apparatus 50 from interfering with the optical sensor. Furthermore, the first distance L1, the second distance L2 and the third distance L3 are set to distances satisfying a predetermined safety standard (e.g., ISO13855 Safe Distance Standard).

Figure 15:
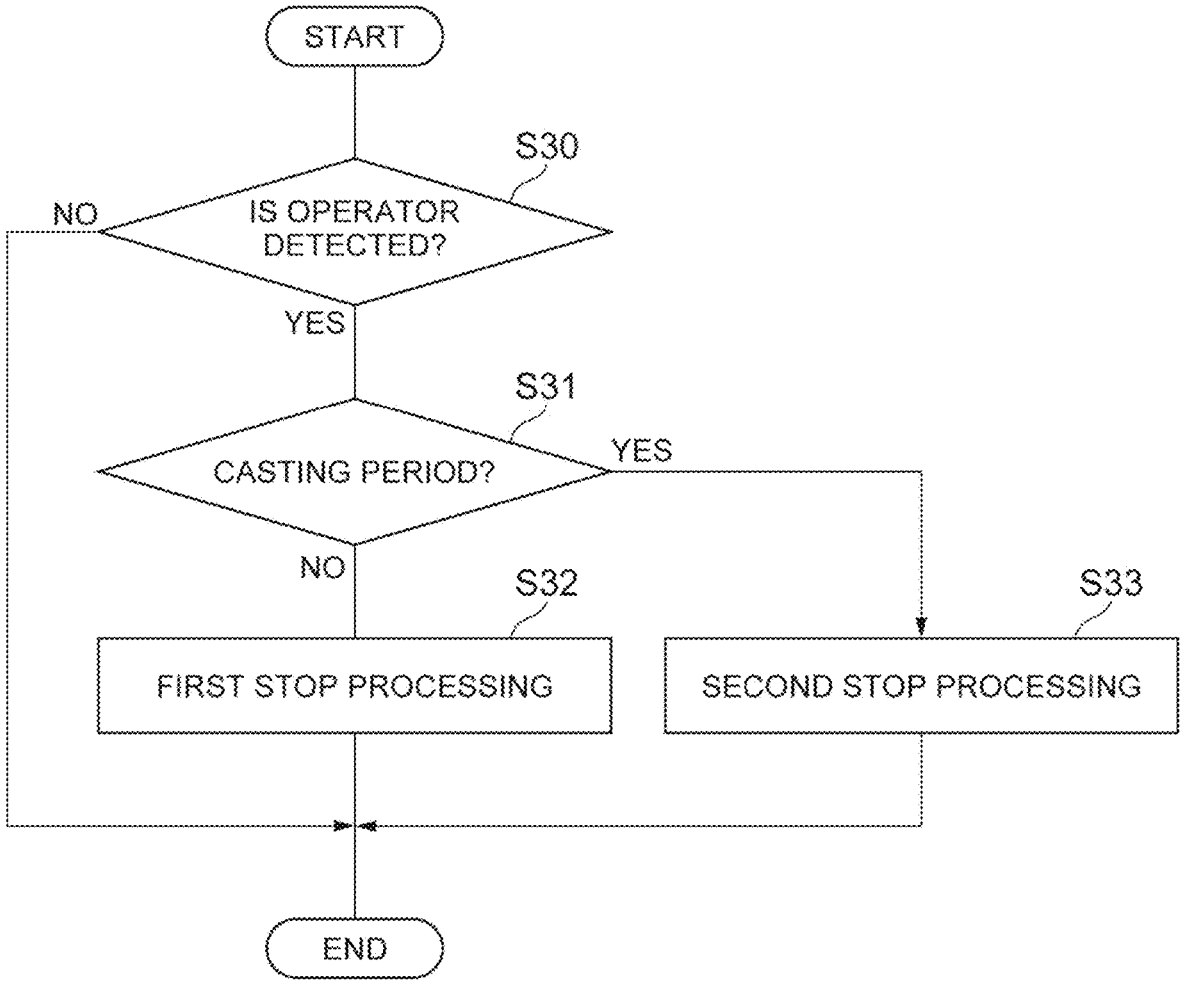
FIG. 15 is a flowchart illustrating an emergency stop method.

FIG. 15 is a flowchart illustrating an emergency stop method. The flowchart shown in FIG. 15 is executed by the main controller 60 at timing at which a power supply to the casting apparatus 50 is turned ON.

The main controller 60 determines whether or not the operator is detected as a detection determination process (step S30). The main controller 60 determines whether or not the operator is detected based on the detection result of the optical sensor 63.

When it is determined that the operator is detected (step S30: YES), the main controller 60 determines whether or not the detection timing at which the operator is detected is included in the casting period as a period determination process (step S31). For example, the main controller 60 determines a start of the casting period based on timing of pressing a tilt start button or timing of outputting a tilt start control signal. The main controller 60 determines an end of the casting period based on an elapsed time from the tilt start or a mold temperature. The main controller 60 determines whether or not detection timing (detection time) of the optical sensor 63 is included in the casting period.

When it is determined that the detection timing is not included in the casting period (step S31: NO), the main controller 60 performs first stop processing of shutting off the power supplies 74 and 81 of the first drive unit 61 and the second drive unit 62 as a first stop processing process (step S32). The main controller 60 operates a switch for shutting off electrical connections between the first drive unit 61 and the second drive unit 62 and power supplies 74 and 81.

When it is determined that the detection timing is included in the casting period (step S31: YES), the main controller 60 performs second stop processing without shutting off the power supplies 74 and 81 of the first drive unit 61 and the second drive unit 62 but causing the first drive unit 61 to continue mold closing and causing the second drive unit 62 to hold the tilting position as a second stop processing process (step S33).

When it is determined that the operator is not detected (step S30: NO), if the first stop processing process (step S32) or the second stop processing process (step S33) ends, the flowchart shown in FIG. 15 ends. After that, the main controller 60 executes the flowchart shown in FIG. 15 from the beginning until termination conditions are satisfied.

Note that when the second stop processing process (step S33) ends and the casting period ends, the main controller 60 accepts operation of a temporary stop cancellation button by the operator. Upon accepting the operation of the temporary stop cancellation button, the main controller 60 resumes casting from the stopped state in the second stop processing process.

As described so far, according to the casting apparatus 50 of the first embodiment, when the optical sensor 63 detects the operator (object), the power supplies 74 and 81 of the first drive unit 61 and the second drive unit 62 are shut off. Thereby, operations of the first drive unit 61 and the second drive unit 62 are completely stopped. On the other hand, when the operations of the first drive unit 61 and the second drive unit 62 are completely stopped during the casting period after molten metal is supplied to the upper mold 1 and the lower mold 2 tilted by the second drive unit 62 until the molten metal is cooled, there is a possibility that the molten metal may not be supplied sufficiently in the metal die without being able to hold the tilting positions, may coagulate in such a state, making it difficult to remove the molten metal from the metal die or the metal die may be opened without the molten metal coagulating sufficiently. If such a situation occurs, it takes time to recover. For this reason, when the optical sensor 63 detects an operator during the above casting period, the casting apparatus 50 does not shut off the power supplies 74 and 81 of the first drive unit 61 and the second drive unit 62, but the first drive unit 61 continues mold closing and the second drive unit 62 holds the tilting position. It is thereby possible to prevent the molten metal from coagulating when its amount is insufficient or prevent the metal die from opening, and so it is possible to speedily restore the apparatus even when it is stopped in emergency.

According to the casting apparatus 50, when the optical sensor 63 detects an operator during the above casting period, the power supply to the first drive unit 61 is not shut off, the hydraulic pump 71 continues driving, and torque by the first actuator is kept, and so mold closing can be continued. Furthermore, according to the casting apparatus 50, when the optical sensor 63 detects an operator during the above casting period, the power supply to the second drive unit 62 is not shut off and the torque by the rotation actuator 16 is kept, and it is thereby possible to keep the tilting position. To start the second drive unit with the power shut off, it is necessary to perform a positioning operation and perform origin returning processing to determine a reference position. According to the casting apparatus 50, since no origin returning processing is necessary, time required for returning can be avoided.

Second Embodiment

Figure 16:
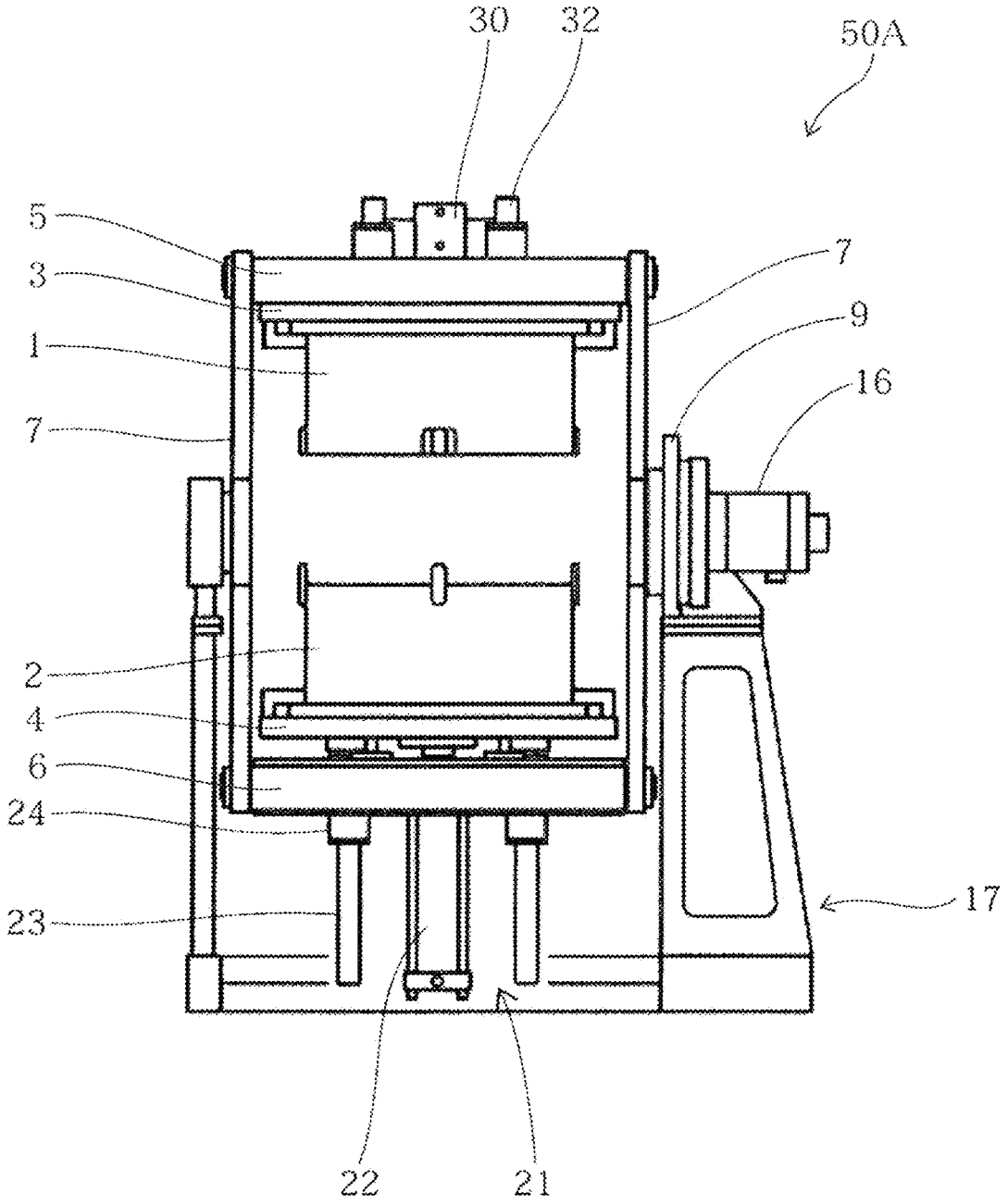
FIG. 16 is a front view of a casting apparatus according to a second embodiment.

FIG. 16 is a front view of a casting apparatus according to a second embodiment. As shown in FIG. 16, a casting apparatus 50A according to the second embodiment is different from the casting apparatus 50 according to the first embodiment mainly in that the opening/closing mechanism 21 moving the lower mold 2 up and down is provided in the lower frame 6. Thus, the lower mold 2 of the casting apparatus 50A can move up and down. Hereinafter, differences between the casting apparatus 50A according to the second embodiment and the casting apparatus 50 according to the first embodiment will be described mainly and common description thereof will be omitted.

Figure 17:
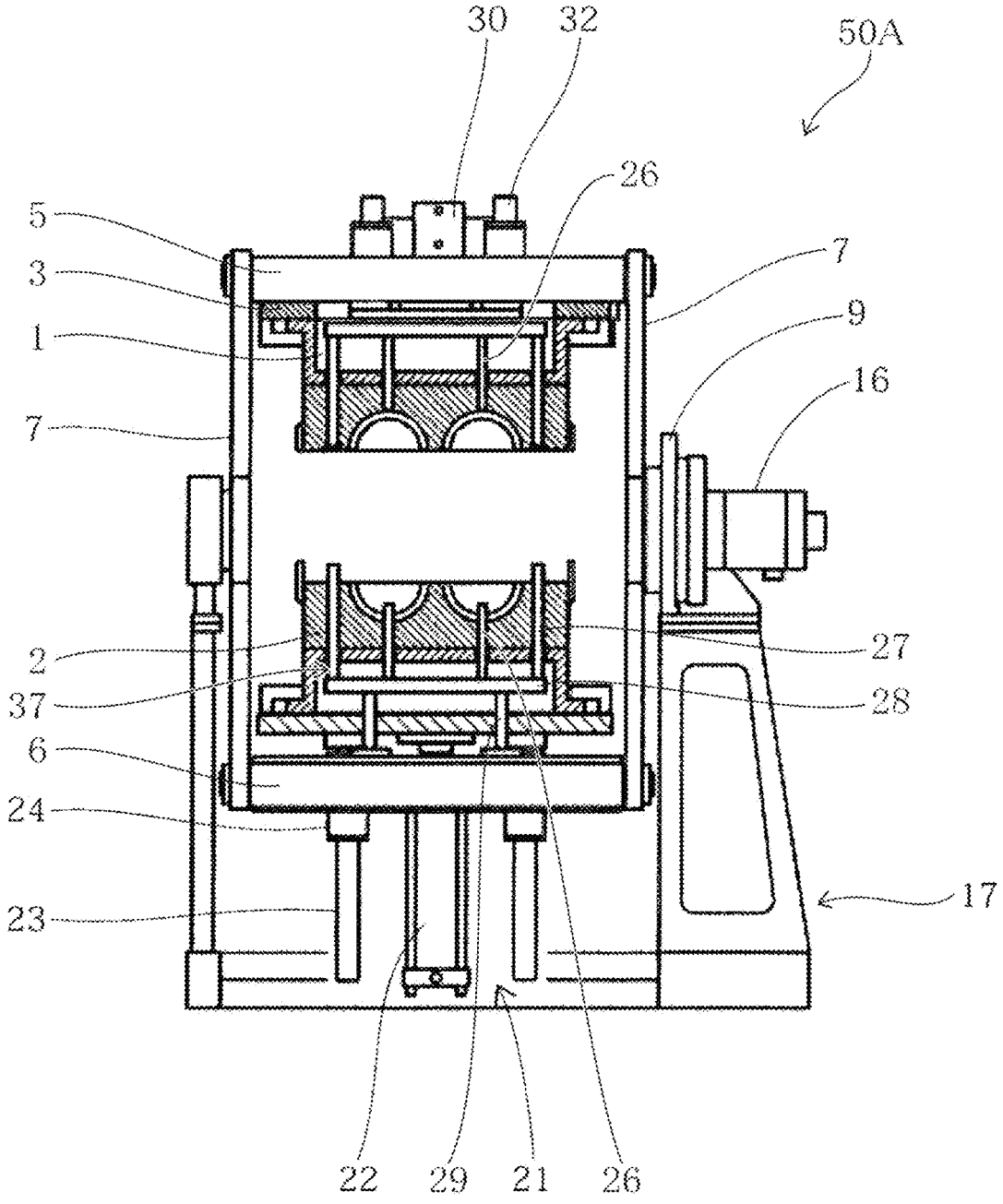
FIG. 17 is a diagram illustrating a cross section of an upper mold and a lower mold in FIG. 16.

FIG. 17 is a diagram illustrating cross sections of the upper die and the lower die in FIG. 16. As shown in FIG. 17, in the casting apparatus 50A, the second actuator 30 is provided in the upper frame 5 and the pushing out mechanism 37 is provided in the lower frame 6. In the casting apparatus 50A, the pushing out plate 28 is disposed in an inner space formed in the interior on the bottom end side of the lower mold 2. Each pushing out pin 26 is provided on the top surface of the pushing out plate 28. Each pushing out pin 26 moves up and down through a hole from the inner space of the lower mold 2 to a cavity in which a casting is formed. A distal end of each pushing out pin 26 pushes out the casting in the cavity. Each return pin 27 is provided at a position different from the pushing out pin 26 at the top surface of the pushing out plate 28. Each return pin 27 moves up and down through the hole from the inner space of the lower mold 2 to the top surface of the lower mold 2. In a process in which the upper mold 1 and the lower mold 2 are closed, the distal end of each return pin 27 is abutted against the undersurface of the upper mold 1 to thereby cause the pushing out plate 28 to move down.

Each push rod 29 is provided on the top surface of the lower frame 6. Each push rod 29 is disposed on the top surface of the lower frame 6 by penetrating the lower mold die base 4. Each push rod 29 is inserted into a hole penetrating from the undersurface of the lower mold 2 to the inner space and the distal end of each push rod 29 is disposed below the pushing out plate 28 in the inner space. The length of each push rod 29 is set to a length that the pushing out plate 28 is pushed up when the first actuator 22 is contracted and the lower mold 2 becomes a descending end. That is, each push rod 29 passes through the hole penetrating an inner space formed at a lower position of the lower mold 2 from the undersurface of the lower mold 2 and enters the inner space by a predetermined length to prevent the pushing out plate 28 from moving down. The rest of the configuration is the same as that of the casting apparatus 50 according to the first embodiment.

According to the casting method for the casting apparatus 50A, in above step S21, mold removal from the upper mold 1 and mold opening are performed in parallel. More specifically, the casting apparatus 50A causes the lower mold 2 to move down through the opening/closing mechanism 21 provided in the lower frame 6 and starts mold opening of the upper mold 1 and the lower mold 2. Simultaneously with this, the casting apparatus 50A starts extending operation of the second actuator 30 provided in the upper frame 5. Extension of the second actuator 30 causes the pushing out pin 26 incorporated in the upper mold 1 to be pushed out. In this way, a casting (not shown) made of molten metal coagulating in the upper mold 1 and the lower mold 2 is removed from the upper mold 1 and held to the lower mold 2. In above process S23, mold removal from the lower mold 2 is performed. More specifically, the opening/closing mechanism 21 causes the lower mold 2 to move down to a descending end. Thus, the distal end of the push rod 29 relatively pushes out the pushing out pin 26 with respect to the lower mold 2 via the pushing out plate 28 incorporated in the lower mold 2. As a result, the casting held to the lower mold 2 is removed from the lower mold 2.

The casting apparatus 50A exerts the same effects as those of the aforementioned casting apparatus 50.

The respective embodiments have been described so far, but the present disclosure is not limited to the above respective embodiments. For example, instead of the second actuator 30 removing a casting from the upper mold 1 or the lower mold 2, the pushing out plate 28 may be pushed out using a spring. In that case, at the time of mold closing of the upper mold 1 and the lower mold 2, the return pin 27 of the lower mold 2 is pressed down by the upper mold 1 and the pushing out pin 26 is lowered, in which a mold closing force is offset by the pressing force of the return pin 27, but it is possible to reduce the number of actuators.

It is possible to provide more than one casting apparatus 50. At this time, there is no limit to an arrangement of the casting apparatus as long as the pouring apparatus can pour molten metal. The core may be fitted not only by the operator but also by a core fitting robot provided with articulated arms. The opening/closing mechanism 21 may cause both the upper mold 1 and the lower mold 2 to move up and down.

The first actuator 22 is not limited to a hydraulic actuator but may also be an electric actuator. For example, the first actuator 22 may be constructed of an electric cylinder and a drive control unit (first electric control unit).

The rotation actuator 16 is not limited to an electric actuator, but may be a hydraulic actuator such as a hydraulic motor. For example, the rotation actuator 16 may be connected to the hydraulic unit. The hydraulic circuit of the hydraulic unit may include a hydraulic pump (second hydraulic pump), an electric motor (second pump electric motor), a solenoid valve (not shown), an oil tank (not shown) or the like. The hydraulic unit may be provided with a drive control unit (second drive control unit) controlling the number of revolutions of the electric motor.

REFERENCE SIGNS LIST

1 . . . upper mold, 2 . . . lower mold, 5 . . . upper frame, 6 . . . lower frame, 7 . . . a pair of main link members, 7*a* . . . first main link member, 7*b* . . . second main link member, 8 . . . a pair of sub-link members, 8*a* . . . first sub-link member, 8*b* . . . second sub-link member, 10 . . . tilt rotating shaft, 15 . . . sub-link central part rotating shaft, 16 . . . rotation actuator, 17 . . . base frame, 21 . . . opening/closing mechanism, 22 . . . first actuator, 25 . . . ladle, 25*a* . . . pouring hole, 26 . . . pushing out pin, 27 . . . return pin, 28 . . . pushing out plate, 29 . . . push rod, 30 . . . second actuator, 35 . . . positioning key, 36 . . . key groove, 50, 50A . . . casting apparatus, 60 . . . main controller (control unit), 70 . . . hydraulic unit, 71 . . . hydraulic pump, 72 . . . electric motor, 73 . . . drive control unit.

The invention claimed is:

1. A casting apparatus that forms a casting by using an upper mold and a lower mold, which can be opened, closed, and tilted, into which molten metal is poured by using gravity, the casting apparatus comprising:

a first drive unit configured to move either the upper mold or the lower mold up and down to open or close the upper mold and the lower mold;

a second drive unit configured to tilt the upper mold and the lower mold which are closed by the first drive unit;

an optical sensor disposed in a periphery of the casting apparatus to detect an object; and a control unit configured to shut off power supplies to the first drive unit and the second drive unit when the optical sensor detects the object, wherein when the optical sensor detects an object for a casting period after the molten metal is supplied into the upper mold and the lower mold tilted by the second drive unit until the molten metal is cooled, the control unit does not shut off the power supplies of the first drive unit and the second drive unit, causes the first drive unit to continue mold closing and causes the second drive unit to keep tilting position.

2. The casting apparatus according to claim 1, wherein the first drive unit comprises:

a hydraulic cylinder;

a first hydraulic pump configured to supply hydraulic oil to the hydraulic cylinder;

a first pump electric motor configured to drive the first hydraulic pump; and a first drive control unit configured to control the first pump electric motor.

3. The casting apparatus according to claim 2, wherein the second drive unit comprises:

a hydraulic motor;

a second hydraulic pump configured to supply hydraulic oil to the hydraulic motor;

a second pump electric motor configured to drive the second hydraulic pump; and a second drive control unit configured to control the second pump electric motor.

4. The casting apparatus according to claim 3, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

5. The casting apparatus according to claim 2, wherein the second drive unit comprises:

an electric motor; and a second electric control unit configured to drive the electric motor.

6. The casting apparatus according to claim 5, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

7. The casting apparatus according to claim 2, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

8. The casting apparatus according to claim 1, wherein the first drive unit comprises:

an electric cylinder; and a first electric control unit configured to drive the electric cylinder.

9. The casting apparatus according to claim 8, wherein the second drive unit comprises:

a hydraulic motor;

a second hydraulic pump configured to supply hydraulic oil to the hydraulic motor;

a second pump electric motor configured to drive the second hydraulic pump; and a second drive control unit configured to control the second pump electric motor.

10. The casting apparatus according to claim 9, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

11. The casting apparatus according to claim 8, wherein the second drive unit comprises:

an electric motor; and a second electric control unit configured to drive the electric motor.

12. The casting apparatus according to claim 8, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

13. The casting apparatus according to claim 1, wherein the second drive unit comprises:

a hydraulic motor;

a second hydraulic pump configured to supply hydraulic oil to the hydraulic motor;

a second pump electric motor configured to drive the second hydraulic pump; and a second drive control unit configured to control the second pump electric motor.

14. The casting apparatus according to claim 13, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

15. The casting apparatus according to claim 1, wherein the second drive unit comprises:

an electric motor; and a second electric control unit configured to drive the electric motor.

16. The casting apparatus according to claim 15, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

17. The casting apparatus according to claim 1, further comprising:

an upper frame to which the upper mold is attached;

a lower frame to which the lower mold is attached;

a first main link member, a top end part of which is rotatably connected to the upper frame, a bottom end part of which is rotatably connected to the lower frame and a central part of which is provided with a rotating shaft; and a first sub-link member disposed parallel to the first main link member, a top end part of which is rotatably connected to the upper frame, a bottom end part of which is rotatably connected to the lower frame and a central part of which is provided with a rotating shaft, wherein the upper frame, the lower frame, the first main link member and the first sub-link member constitute a first parallel link mechanism.

18. An emergency stop method for a casting apparatus that forms a casting by using an upper mold and a lower mold, which can be opened, closed, and tilted, into which molten metal is poured by using gravity, the casting apparatus comprising:

a first drive unit configured to move either the upper mold or the lower mold up and down to open or close the upper mold and the lower mold; and a second drive unit configured to tilt the upper mold and the lower mold which are closed by the first drive unit, the emergency stop method comprising steps of:

determining, when an object is detected by an optical sensor disposed in a periphery of the casting apparatus, whether or not detection timing is included in a casting period after the molten metal is supplied into the tilted upper mold and lower mold until the molten metal is cooled; and performing first stop processing, when it is determined that the detection timing is not included in the casting period, in which power supplies to the first drive unit and the second drive unit are shut off or performing second stop processing, when it is determined that the detection timing is included in the casting period, in which the power supplies to the first drive unit and the second drive unit are not shut off, the first drive unit is caused to continue mold closing and the second drive unit is caused to keep tilting position.

* * * * *